US006222510B1

(12) United States Patent
Etoh

(10) Patent No.: US 6,222,510 B1
(45) Date of Patent: Apr. 24, 2001

(54) DISPLAY UNIT

(75) Inventor: Chikara Etoh, Nagasaki (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/467,878

(22) Filed: Jun. 6, 1995

(30) Foreign Application Priority Data

Sep. 2, 1994 (JP) ..... 6-210156

(51) Int. Cl.[7] ..... G09G 3/20
(52) U.S. Cl. ..... 345/55; 345/89; 345/147
(58) Field of Search ..... 345/87, 89, 94, 345/55, 147; 359/56

(56) References Cited

U.S. PATENT DOCUMENTS 5,465,102 * 11/1995 Usmi et al. ..... 345/89
5,521,727 * 5/1996 Inaba et al. ..... 345/89

FOREIGN PATENT DOCUMENTS 0 130 249 6/1983 (EP) .
0 149 899 7/1985 (EP) .
0 513 551 11/1992 (EP) .
2 204 174 11/1988 (GB) .
62-177592 8/1987 (JP) .
2-709 1/1990 (JP) .

* cited by examiner

*Primary Examiner*—Matthew Luu
(74) *Attorney, Agent, or Firm*—Burns, Doane, Swecker & Mathis, LLP

(57) ABSTRACT

In a display unit, light emitting pixels are arrayed in a matrix form, an image signal having a half tone can be displayed, and the number of gray scale in a gray image can be increased without an increase in the number of times data is read out from a memory while maintaining a proportional relationship between display data and brightness of a screen. A changing portion generates an ON/OFF signal, in lower order bits in the respective display data read from the memory, according to a value of each of the bits, and compares, in higher order bits in the display data, a value indicated by the bits with a predetermined value so as to output an ON signal when the value indicated by the bits is greater than the predetermined value. The ON/OFF signal is supplied to column electrodes.

18 Claims, 19 Drawing Sheets

FIG. 4 (PRIOR ART)

| | | | |
|---|---|---|---|
| 0 | 1 | 2 | 3 |
| 4 | 5 | 6 | 7 |
| 8 | 9 | A | B |
| C | D | E | F |

FIG. 5 (PRIOR ART)

| | | | |
|---|---|---|---|
| 1111 | 1010 | 1100 | 0000 |
| 1000 | 0100 | 0010 | 1110 |
| 0001 | 0000 | 0011 | 1011 |
| 1001 | 0101 | 0110 | 0111 |

FIG. 6 (PRIOR ART)

| ADDRESS | | DATA | |
|---|---|---|---|
| HEXADECIMAL | BINARY | HEXADECIMAL | DECIMAL |
| 0 | 0000 | 1111 | 15 |
| 1 | 0001 | 1010 | 10 |
| 2 | 0010 | 1100 | 12 |
| 3 | 0011 | 0000 | 0 |
| 4 | 0100 | 1000 | 8 |
| 5 | 0101 | 0100 | 4 |
| 6 | 0110 | 0010 | 2 |
| 7 | 0111 | 1110 | 14 |
| 8 | 1000 | 0001 | 1 |
| 9 | 1001 | 0000 | 0 |
| A | 1010 | 0011 | 3 |
| B | 1011 | 1011 | 11 |
| C | 1100 | 1001 | 9 |
| D | 1101 | 0101 | 5 |
| E | 1110 | 0110 | 6 |
| F | 1111 | 0111 | 7 |
| | Y ADDRESS X ADDRESS | | |

| ADDRESS | S1 | S2 | B(0) | B(1) |
|---|---|---|---|---|
| 0 | 0 | 0 | X | X |
| 1 | 1 | 0 | X | X |
| 2 | X | 1 | 0 | 0 |
| 3 | X | 1 | 1 | 0 |
| 4 | X | 1 | 0 | 1 |

DISPLAY UNIT

BACKGROUND OF THE INVENTION

1. Field of the Invention

The present invention relates to a display unit in which light emitting pixels are arrayed in a matrix form, and an image signal having a half tone can be displayed.

2. Description of the Prior Art

FIG. 1 is a block diagram showing a conventional display unit disclosed in Japanese Patent Publication (Kokoku) No. 2-709. In FIG. 1, reference numeral 1 denotes a matrix display panel such as a fluorescent character display tube, 2 is a driver to drive row electrodes of the matrix display panel 1, and 3 is another driver to drive column electrodes of the matrix display panel 1. Display elements (light emitting elements) are disposed at intersections of the row electrodes and the column electrodes, and are turned ON by driving the corresponding row electrode and the corresponding column electrode. Reference numeral 4 denotes a shift register to place an ON/OFF signal from a changing portion 15 on the corresponding column electrode, 5 is a row electrode control circuit to create a drive signal for the row electrode, and 6 is a column electrode control circuit to create a drive signal for the column electrode. The column electrode control circuit 6 latches output of the shift register 4 for a predetermined time interval depending upon a latch signal from a timing generating circuit 8.

Reference numeral 9 denotes a display control unit to write display data onto a memory 7, 10 is a selector to feed the memory 7 with any one of a read address and a write address, 11 is a read/write control circuit to feed the selector 10 with a switching signal, 12 is a clock generating circuit to feed a clock signal to the timing generating circuit 8 and the read/write control circuit 11, 13 is a read address counter to generate the read address, and 15 is the changing portion to transform data read from the memory 7 into the ON/OFF signal for pixel.

The matrix display panel 1 is provided with a structure as shown in FIG. 2. That is, the display elements are disposed at intersections of a group of signal lines for feeding signals to the column electrodes $X_1$ to $X_m$ and a group of signal lines for feeding signals to the row electrodes $Y_1$ to $Y_m$. Thus, the display elements are controlled according to a combination of the signals fed to the two groups of signal lines.

A description will now be given of the operation. The display control unit 9 outputs the display data, an address corresponding to a position at which the display data is displayed, and a timing signal in synchronization with the display data. The timing signal is inputted into the read/write control circuit 11. The read/write control circuit 11 receives the timing signal as input, and thereafter outputs a signal by which the selector 10 is switched over to the write address. Therefore, the address from the display control unit 9 is fed to the memory 7 as the write address. As a result, the display data can be stored in the memory 7 at an area specified by the write address.

Further, the display data stored in the memory 7 is read out according to the read address which is produced in the read address counter 13. The read address counter 13 generates an X address (a column address) fed to the column electrode control circuit 6, a Y address (a row address) fed to the row electrode control circuit 5, and a comparison signal B. The X address and the Y address are fed into the memory 7 through the selector 10. In this case, the selector 10 selects the read address according to control by the read/write control circuit 11. Consequently, it is possible to output data from the memory 7 according to the read address including the X address and the Y address.

Further, the Y address is sent to the row electrode control circuit 5. The row electrode control circuit 5 decodes the Y address so as to drive the row electrodes $Y_1$ to $Y_m$ of the matrix display panel 1 through the driver 2. The data read from the memory 7 is sent to the changing portion 15. The changing portion 15 compares the data with the comparison signal B produced in the read address counter 13 so as to generate an ON/OFF signal according to the result of comparison. When the data is greater than the signal B, the ON signal is generated. When the data is equal to or less than the signal B, the OFF signal is generated. Here, '1' shows the ON signal and '0' shows the OFF signal. The ON/OFF signal is disposed in the shift register 4 according to a shift clock from the timing generating circuit 8. Further, the signal is latched by the column electrode control circuit 6 in response to a latch signal from the timing generating circuit 8. In response to the latched signal, the column electrode control circuit 6 drives the column electrodes $X_1$ to $X_m$ through the driver 3.

In such a display unit, an image is displayed by sequentially and periodically driving the row electrodes $Y_1$ to $Y_m$, and by switching operation of a signal which is fed to the column electrodes $X_1$ to $X_m$ in synchronization with the driving of the row electrodes $Y_1$ to $Y_m$. The display elements can exclusively provide binary representation, that is, any one of ON and OFF. However, when an image signal having a half tone should be displayed, the data in the memory is read out a predetermined number of times, and a cumulative elapsed ON time in each display element is controlled, thereby realizing gray image display.

A more detailed description will now be given of a display operation by way of, as an example, the matrix display panel 1 including a device having a 4-by-4 pixel array. Pixel positions in the matrix display panel 1 correspond to memory addresses in a one-to-one manner, resulting in a relationship as shown in FIGS. 3 and 4. FIG. 3 shows the pixel positions, and FIG. 4 shows the memory addresses corresponding to the respective pixel positions. FIG. 5 shows illustrative display data stored in the memory 7 at the respective addresses. As shown in FIG. 6, the addresses of the memory 7 can be classified into the X address and the Y address. FIG. 9 is a timing diagram showing row electrode driving timing and column electrode driving timing. FIG. 10 is an explanatory view showing the result of the driving.

When the display data corresponding to each pixel includes a 4-bit structure, it is possible to display a 16-scale gray image (because of $2^4$=16). In this case, as shown in FIG. 7, the read address counter 13 includes a 2-bit counter 13*a* for generating the X address, a 4-bit counter 13*b* for generating the comparison signal B, and a 2-bit counter 13*c* for generating the Y address. The 2-bit counter 13*b* counts the clock signal from the read/write control circuit 11 to sequentially output values of 0 to 3 corresponding to the column electrodes $X_1$ to $X_4$. The 4-bit counter 13*b* counts a carry signal of the 2-bit counter 13*a*. In the 4-bit counter 13*b*, an initial value is set to zero. The 2-bit counter 13*c* counts a carry signal of the 4-bit counter 13*b*. The initial value of zero in the 2-bit counter 13*c* corresponds to the row electrode $Y_1$.

Accordingly, with the comparison signal B of zero and the Y address of zero, four data stored in the first row shown in FIG. 5 are sequentially read out. As shown in FIG. 8, the changing portion 15 comprises, for example, a comparator 15*a*. The comparator 15*a* compares display data A with the comparison signal B so as to output an ON signal when A is greater than B, or output an OFF signal when A is equal to or less than B. As shown in FIGS. 5 and 6, the first row sequentially contains data of "15 (in decimal notation)," "10 (in decimal notation)," "12 (in decimal notation)," and "0". Since the comparison signal B is zero, the changing portion 15 sequentially outputs "1," "1," "1," and "0". Signals from the changing portion 15 are sequentially inputted into the shift register 4.

When the respective signals in the first row are inputted into the shift register 4, the timing generating circuit 8 outputs the latch signal such that the contents of the shift register 4 can be latched by the column electrode control circuit 6. The column electrode control circuit 6 drives the column electrodes $X_1$ to $X_4$ through the driver 3 according to the contents of the shift register 4. At the time, a value of zero is fed into the row electrode control circuit 5 as the Y address so that the row electrode control circuit 5 can drive the row electrode $Y_1$ in the first row through the driver 2. Thus, as shown by a period t1 in FIGS. 9 and 10, display elements at intersections of the first row and the first to third columns are turned ON, and a display element at an intersection of the first row and the fourth column is not turned ON. In FIG. 10, a hollow ring denotes a display element which is turned ON, and a numeral in the hollow ring denotes an ON time interval. Further, reference numerals t1 to t64 correspond to reference numerals t1 to t64 in FIG. 9.

Next, by the read/write control circuit 11, a count value of the 2-bit counter 13*a* is reset to zero, and a count value of the 4-bit counter 13*b* is set to one. A count value of the 2-bit counter 13*c* is zero. Consequently, the four display data in the first row are read from the memory 7 again, and the display data are compared with the comparison signal B (=1) in the changing portion 15. According to the result of comparison, the changing portion 15, the shift register 4, the column electrode control circuit 6, and row electrode control circuit 5 are operated as set forth above. Therefore, as shown by a period t2 in FIGS. 9 and 10, the display elements are turned ON at the intersections of the first row and the first to third columns, and the display element at the intersection of the first row and the fourth column is not turned ON.

When the count value of the 4-bit counter 13*b* reaches 15 (in decimal notation) after count from 0 to 3 is repeated in the 2-bit counter 13*a*, the changing portion 15 compares the data in the first row from the memory 7 with the comparison signal B (=15). The first row sequentially contains the data of "15 (in decimal notation)," "10 (in decimal notation)," "12 (in decimal notation)," and "0." Because of the comparison signal of 15, the changing portion 15 sequentially outputs "0," "0," "0," and "0." As a result, as shown by a period t16 in FIGS. 9 and 10, all the display elements at the intersections of the first row and the first to fourth columns are not turned ON. As set forth above, comparison is made the number of times identical with the number of gray scale for each row data. As shown at the leftmost end of the first row in FIGS. 9 and 10, according to the result of comparison, the display element corresponding to the address "0" is held ON for a period of 15 unit times, the display element corresponding to the address "1" is held ON for a period of 10 unit times, and the display element corresponding to the address "2" is held ON for a period of 12 unit times. In such a manner, a gray image can visually be displayed according to the ON time periods.

Next, the count values of the 2-bit counter 13*a* and the 4-bit counter 13*b* are reset to zero, thereby setting the count value of the 2-bit counter 13*c* to one. Thus, the above processing is performed for data in the second row corresponding to the Y address "1". As a result, as shown at the leftmost end of the second row in FIGS. 9 and 10, the display element corresponding to the address "4" is held ON for a period of 8 unit times, the display element corresponding to the address "5" is held ON for a period of 4 unit times, the display element corresponding to the address "6" is held ON for a period of 2 unit times, and the display element corresponding to the address "7" is held ON for a period of 14 unit times.

The above processing is similarly carried out for data in the third row (the Y address of 2) and the fourth row (the Y address of 3), resulting in completion of the display operation in one frame. In the conventional display unit shown in FIG. 1, all the ON signals have a constant time interval as shown in FIG. 11, and a pulse number control method is employed in which the gray image display is realized according to the number of the ON signals.

On the other hand, another display unit is known in which pulse width control is made. In such a display unit, as shown in FIG. 12, a changing portion 15 has a selector 15*b* which can select one bit among 4-bit display data from a memory 7 according to a select signal S. The selection of the selector 15*b* results in an ON/OFF signal. Further, a timing generating circuit 8 is controlled to vary a time interval of the ON signal according to a bit weight (selected from weights 1, 2, 4, and 8). FIG. 13 is a timing diagram showing row electrode driving timing and column electrode driving timing. FIG. 14 is an explanatory view showing the result of driving.

In this case, a counter for generating an X address in a read address counter 13 sequentially feeds the memory 7 with values of 0 to 3. Output timing of the values of 0, 1, 2, and 3 do not have a constant interval, but have an interval according to the bit weight. A counter for generating the select signal S is positioned at a subsequent stage of the counter for generating the X address, and is incremented by one after the counter for generating the X address outputs all the values of 0 to 3. Further, another counter for generating a Y address is positioned at a subsequent stage of the counter for generating the select signal S, and is incremented by one after the counter for generating the select signal S outputs all values of 0 to 3.

Therefore, four data in the first row in the memory 7 are respectively read out four times (according to timing of the periods t1 to t4), and are compared with the select signal S for each time. The first select signal S is set to zero, the second select signal S is set to one, the third select signal S is set to two, and the fourth select signal S is set to three. In the first comparison, the changing portion 15 selects and outputs the least significant bit among the 4-bit data from the memory 7. In the second comparison, the changing portion 15 selects and outputs the first bit among the 4-bit data from the memory 7. In the third comparison, the changing portion 15 selects and outputs the second bit among the 4-bit data from the memory 7. Finally, in the fourth comparison, the changing portion 15 selects and outputs the most significant bit among the 4-bit data from the memory 7.

In such a manner, when, for example, data at the address "0" shown in FIG. 6 is outputted from the memory 7 four times, the changing portion 15 outputs "1," "1," "1," and "1" according to the timing of the periods t1 to t4. Since the output respectively have weights 1, 2, 4, and 8, in display modes t1 to t4 in the first row shown in FIG. 14, display is made for time intervals obtained by the leftmost values corresponding to the address "0". When data at the address "1" is outputted from the memory 7 four times, the changing portion 15 outputs "0," "1," "0," and "1" according to the timing of the periods t1 to t4. Thus, in the display modes t1 to t4 in the first row shown in FIG. 14, display is made for time intervals obtained by the second values from the left corresponding to the address "1."

For data at the address "2" and at the address "3," processing identical with the above processing is carried out by the changing portion 15, the timing generating circuit 8, and so forth. In such a manner, signals corresponding to signals in the periods t1 to t4 in FIG. 13 are fed to a row electrode $Y_1$ and column electrodes $X_1$ to $X_4$. As shown by the leftmost display mode in the first row in FIG. 14, a display element corresponding to the address "0" is held ON for a period of 15 unit times, a display element corresponding to the address "1" is held ON for a period of 10 unit times, and a display element corresponding to the address "2" is held ON for a period of 12 unit times.

Subsequently, the Y address fed to both the memory 7 and the row electrode control circuit 5 is set to one, and the same processing as the above processing is carried out for data at the addresses "4" to "7." Thus, in case of data as shown in FIG. 6, signals corresponding to signals in periods t5 to t8 in FIG. 13 are fed to a row electrode $Y_2$ and column electrodes $X_1$ to $X_4$. The same operation is carried out with respect to Y addresses "2" and "3."

In the display unit, the ON signals are set to have four types of time intervals, and a gray image can be realized by a combination of the ON signals as shown in FIG. 15. For example, in case of display data of weight 8, an ON signal having a time interval of 8 is fed to the column electrodes $X_1$ to $X_4$. Alternatively, in case of display data of 7, an ON signal having a time interval of 1, an ON signal having a time interval of 2, and an ON signal having a time interval of 4 are respectively fed to the column electrodes $X_1$ to $X_4$.

In the display unit employing the pulse number control method, the display data must be read out from the memory 7 the number of times identical with the number of gray scale before one frame can be displayed. Hence, when an increase in the number of bits in the display data increases the number of gray scale, it is necessary to operate the memory 7 and the control circuit at a higher velocity. As a result, the increase in the number of gray scale is limited.

In the display unit employing the pulse width control method, the number of times the display data is read from the memory 7, required to display the one frame, becomes equal to the number of bits in the display data. Thus, the pulse width control method requires considerably less number of times of read than the pulse number control method. However, for a short time interval such as the period t1 or t5, it is necessary to read out the display data expressed as the number of bits per data by the number of pixels per row (for example, four bits by four pixels in case of a 16-scale image including a 4-by-4 pixel array). Consequently, it is also necessary to operate the memory 7 and the control circuit at a higher velocity, and the increase in the number of gray scale is limited.

Further, due to influences such as response velocities of drivers 2 and 3 and light emitting elements, or ripple noise in power supply voltage, it becomes difficult to, for example, realize a pulse width corresponding to a time interval of 7 by summing up the ON signals respectively having the time interval of 1, the time interval of 2, and the time interval of 4. As the number of scale is further increased, such a tendency becomes more pronounced. When the scale number is increased, a value of the display data can not easily be made proportional to brightness of the display panel because of the following reason. That is, when the number of gray scale is increased to reduce an interval of the ON signal, sometimes supply of the ON signal fails to turn ON the display element by a response rise delay time and so forth due to the influences such as response velocity of the display element. That is, at times, the value of the display data can not easily be made proportional to brightness of display.

In addition, both the control circuit in the pulse number control method and the control circuit in the pulse width control method feed the ON signals to the column electrodes and the row electrodes according to the same timing. As a result, an expensive circuit having a higher response velocity is required for both a column electrode drive circuit and a row electrode drive circuit.

SUMMARY OF THE INVENTION

The present invention overcomes the above problems, and it is an object of the present invention to provide a display unit in which the number of gray scales in a gray image can be increased without an increase in the number of times data is read out from a memory while maintaining a proportional relationship between a value of display data and brightness of a screen.

It is another object of the present invention to provide a display unit which does not require a higher read velocity of a memory even when a time interval of an ON time is reduced due to an increase in the number of gray scales in image display.

It is still another object of the present invention to provide a display unit which can compensate response delay times in a driver circuit and a display element.

It is a further object of the present invention to provide a display unit which can prevent a response velocity of a column electrode driver from having an effect on a display image.

According to one aspect of the present invention, for achieving the above-mentioned objects, there is provided a display unit having a matrix display panel including display elements disposed at intersections of a group of row electrodes and a group of column electrodes, a memory in which display data is stored, a changing portion to generate an ON/OFF signal, in lower order bits in display data read from the memory, according to a value of each bit, and to compare, in higher order bits in the display data, a value indicated by the bits with a predetermined value so as to output an ON signal when the value indicated by the bits is greater than the predetermined value, a column electrode control circuit to apply voltage to the group of column electrodes of the matrix display panel according to the ON/OFF signal from the changing portion, and a row electrode control circuit to apply row voltage to the group of row electrodes of the matrix display panel.

In the display unit, the display data from the memory is divided into two higher order bits and two lower order bits. Pulse number control is employed as control using the two higher order bits, that is, as rough gray scale control. Pulse width control is employed as control using the two lower order bits, that is, as fine gray scale control. Thus, in the rough gray scale control, an additional ON signal is provided according to an increase in a value indicated by the display data so that the display data can be made proportional to brightness of the panel. On the other hand, in the fine gray scale control, ON signals having different pulse widths are combined so that the number of times data is read from the memory can be reduced. In addition, even when, for example, the display data is switched over from the 127th-scale to the 128th-scale, the display data can easily be made proportional to the brightness of the panel in the pulse width control method.

According to another aspect of the present invention, there is provided a display unit in which a row electrode control circuit includes a gate circuit to output each row voltage which is held ON for a period corresponding to weight of each lower order bit in display data when a column electrode control circuit applies voltage to a group of column electrodes according to an ON/OFF signal for the lower order bits in the display data, and to output row voltage which is held ON for a period corresponding to a value obtained by duplicating the maximum value among the weights of the lower order bits when the column electrode control circuit applies voltage to the group of column electrodes according to an ON/OFF signal for higher order bits in the display data.

According to still another aspect of the present invention, there is provided a display unit further having a read address counter to read out the same display data from the memory the number of times expressed as [(exponent or index/2)+[the (exponent or index/2)th power of 2]−1] which is the number of gray scale in the display data expressed according to a power method of 2.

According to a further aspect of the present invention, there is provided a display unit further having a changing control circuit to feed a changing portion with a select signal indicating whether processing should be carried out for higher order bits or for lower order bits in display data, and to feed the changing portion with the predetermined value with which the value indicated by the higher order bits in the display data is compared, the number of times expressed as [[the (exponent or index/2)th power of 2]−1].

According to a still further aspect of the present invention, there is provided a display unit in which a read address counter controls such that display data can be outputted from a memory on a constant cycle.

According to a still further aspect of the present invention, there is provided a display unit in which a row electrode control circuit outputs row voltage whose rise portion is set in an OFF state for each cycle. That is, a blanking time is provided prior to an ON signal applied to a row electrode so that an operation cycle of a column electrode control circuit can be extended. As a result, there is an effect in that a memory having a higher read velocity is not required even when a time interval of the ON signal is reduced due to an increase in the number of gray scale.

According to a still further aspect of the present invention, there is provided a display unit in which a row electrode control circuit includes a pulse width extending circuit to extend a time interval of an ON signal by a rise delay time of a driver for a matrix display panel, or by a response delay time of a display element. The time interval of the ON signal is extended so that response delay times of the driver circuit and the display element can be compensated.

According to a still further aspect of the present invention, there is provided a display unit in which a row electrode control circuit controls to provide an OFF state during rise and fall operations of a driver on the side of a column electrode. As a result, it is possible to prevent a response velocity of the driver for the column electrode from having an effect on a display image.

BRIEF DESCRIPTION OF THE DRAWINGS

FIG. 4 is an explanatory view showing addresses in a memory including a 4-by-4 pixel array;

FIG. 5 is an explanatory view showing illustrative display data;

FIG. 6 is an explanatory view showing a relationship between memory addresses and data;

DETAILED DESCRIPTION OF THE PREFERRED EMBODIMENT

Figure 16:
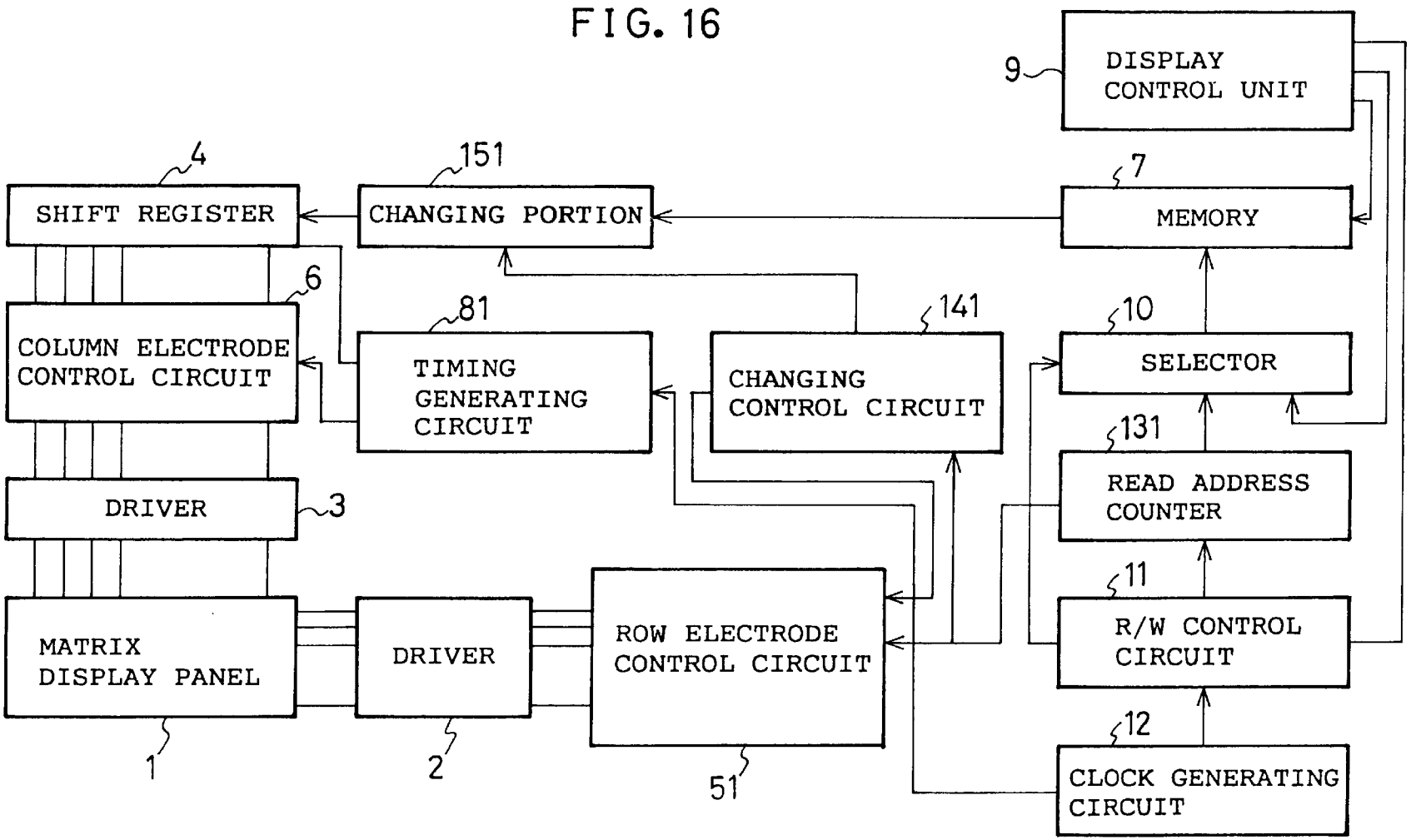
FIG. 16 is a block diagram showing one embodiment of a display unit of the present invention.

FIG. 16 is a block diagram showing a structure of one embodiment of a display unit of the present invention. In FIG. 16, reference numeral 1 denotes a matrix display panel such as fluorescent character display tube, 2 is a driver to drive row electrodes of the matrix display panel 1, and 3 is a driver to drive column electrodes of the matrix display panel 1. Display elements are disposed at intersections of the row electrodes and the column electrodes, and are turned ON by driving the corresponding row electrode and the corresponding column electrode. Reference numeral 4 denotes a shift register to place an ON/OFF signal from a changing portion 15 on the corresponding column electrode, 51 is a row electrode control circuit to create a drive signal for the row electrode, and 6 is a column electrode control circuit to create a drive signal for the column electrode. The column electrode control circuit 6 latches output of the shift register 4 for a predetermined time interval depending upon a latch signal from a timing generating circuit 81.

Reference numeral 9 denotes a display control unit to write image data onto a memory 7, 10 is a selector to feed the memory 7 with any one of a read address and a write address, 11 is a read/write control circuit to feed the selector 10 with a switching signal, 12 is a clock generating circuit to feed a clock signal to the timing generating circuit 81 and the read/write control circuit 11, 131 is a read address counter to generate the read address, 141 is a changing control circuit to create select signals SI and S2, and a comparison signal B (shown in FIG. 17), and 151 is the changing portion to transform data read from the memory 7 into the ON/OFF signal for pixel.

Figure 17:
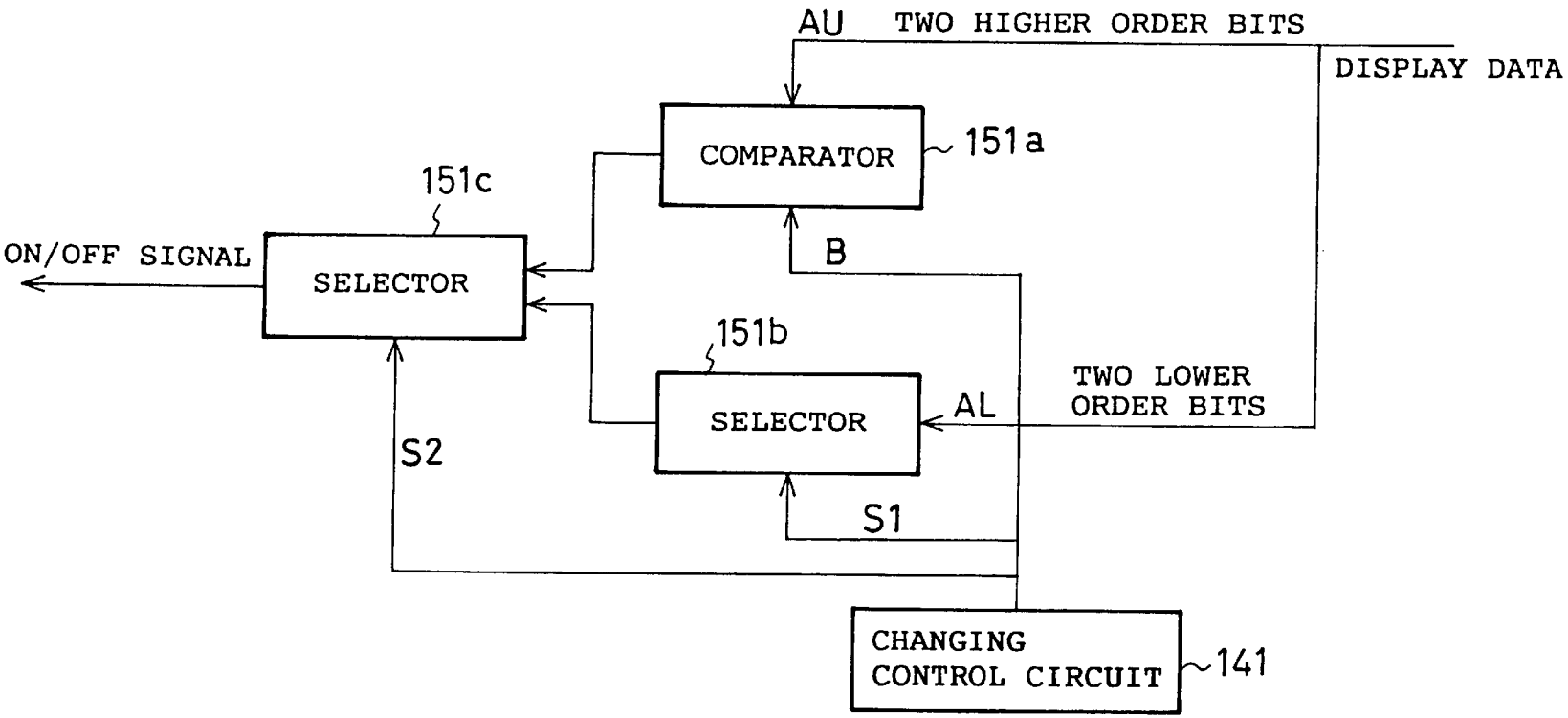
FIG. 17 is a block diagram showing a detailed structure of a changing portion.

FIG. 17 is a block diagram showing a detailed structure of the changing portion 151. In FIG. 17, reference numeral 151*a* denotes a comparator to compare a plurality of higher order bits in display data from the memory 7 (i.e., bits for specifying a row address in the memory 7) with the comparison signal B from the changing control circuit 141. The comparison signal B is a 2-bit signal which is compared with the display data so as to transform the display data into an ON/OFF signal in a pulse number control method. Thus, the 2-bit signals are transformed into the ON/OFF signal in the order of the higher order bits in the display data.

Reference numeral 151*b* denotes a selector to select one bit of a plurality of lower order bits in the display data according to the select signal S1 from the changing control circuit 141. If the display data has a 4-bit structure, the selector 151*b* selects the least significant bit in the display data when the select signal S1 is zero, or selects the second least significant bit when the select signal S1 is one so as to use the selected bit as the ON/OFF signal. Reference numeral 151*c* denotes a selector to select either the ON/OFF signal created depending upon the higher order bits or the ON/OFF signal created depending upon the lower order bits according to the select signal S2 from the changing control circuit 141. Further, the selector 151*c* outputs the result of selection to the shift register 4, and selects the ON/OFF signal created depending upon the lower order bits when the select signal S2 is zero.

Figure 1:
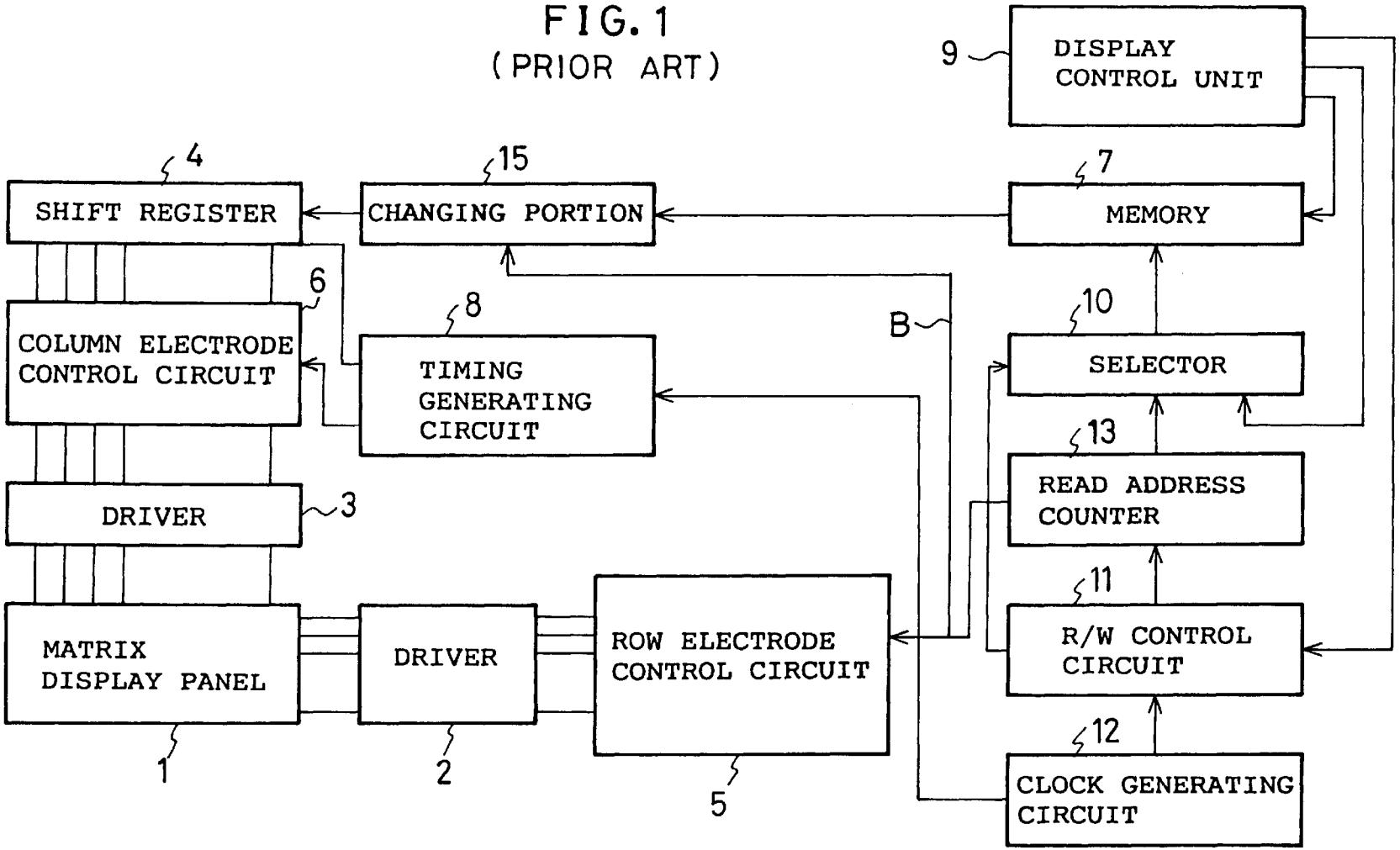
FIG. 1 (PRIOR ART)
FIG. 1 is a block diagram showing a conventional display unit.
Figure 2:
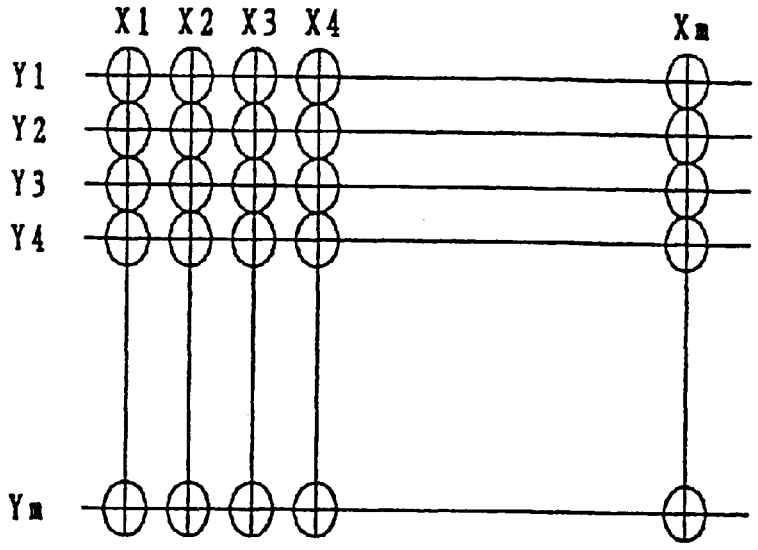
FIG. 2 (PRIOR ART)
FIG. 2 is an explanatory view showing a pixel array in a typical display panel.
Figure 3:
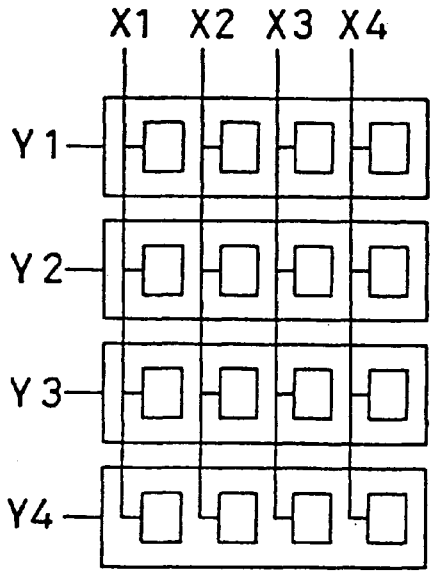
FIG. 3 (PRIOR ART)
FIG. 3 is an explanatory view showing a relationship between the pixel array and both row electrodes and column electrodes in the display panel.
Figure 7:
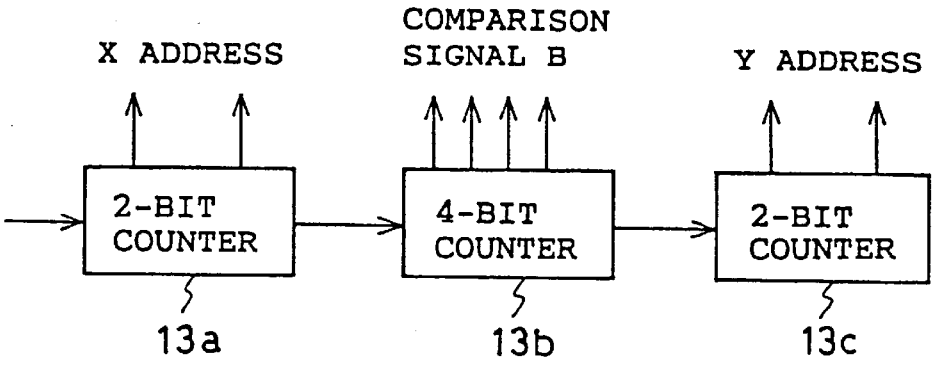
FIG. 7 (PRIOR ART)
FIG. 7 is a block diagram showing a detailed structure of a read address counter.
Figure 8:
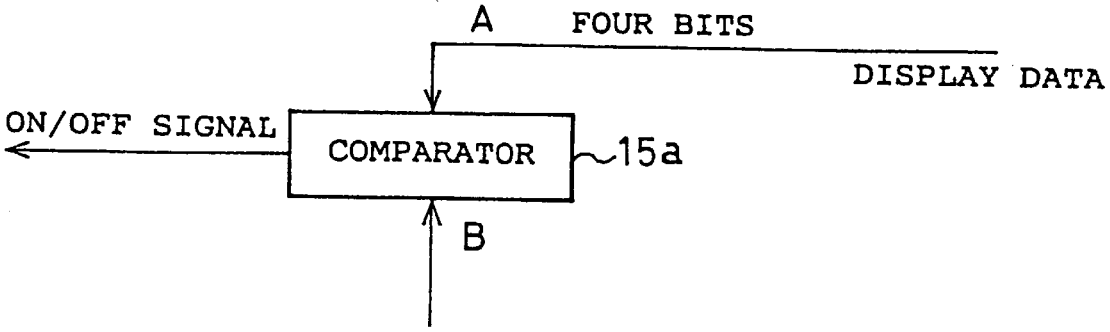
FIG. 8 (PRIOR ART)
FIG. 8 is a block diagram showing an illustrative changing portion.
Figure 9:
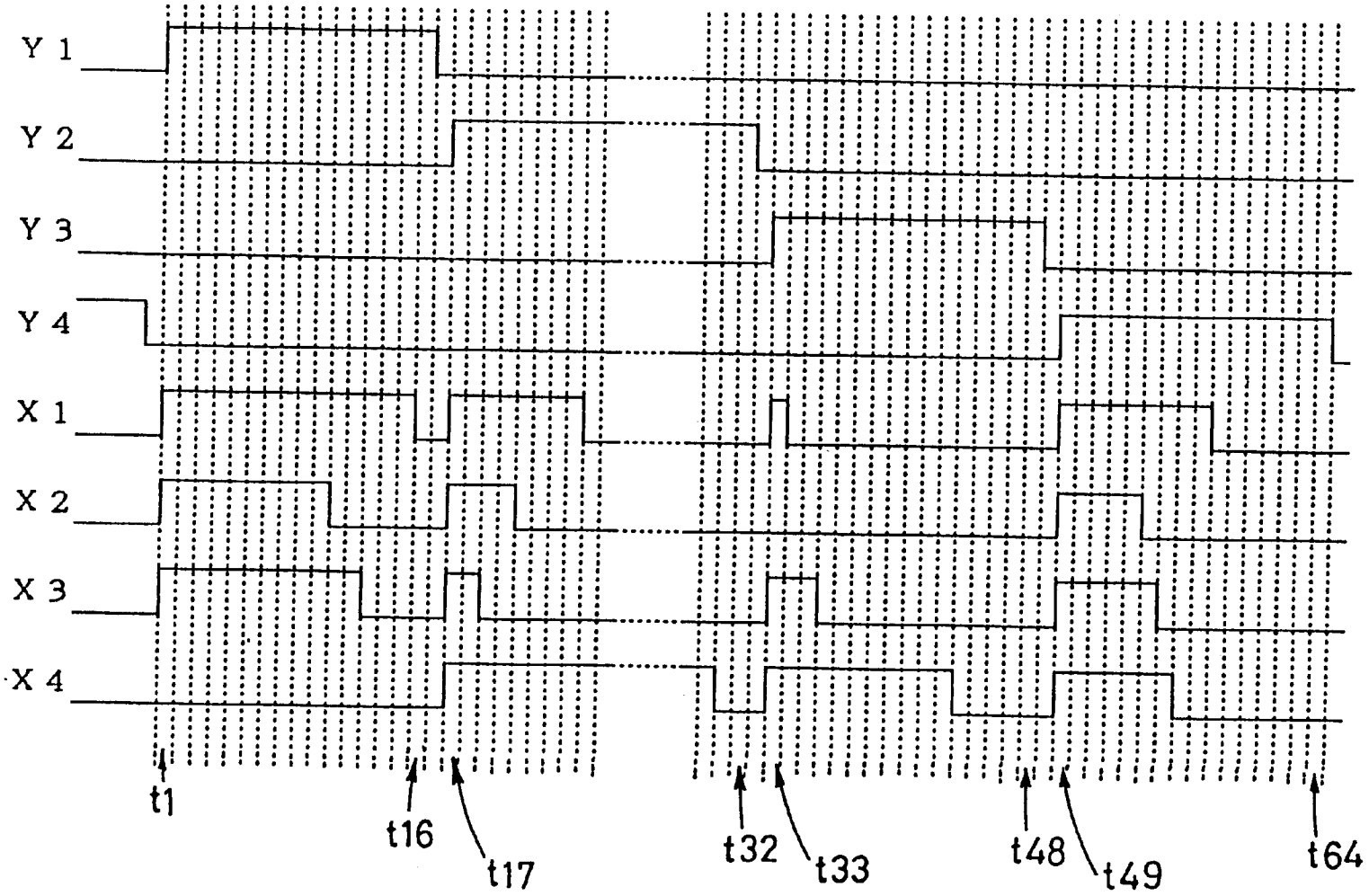
FIG. 9 (PRIOR ART)
FIG. 9 is a time chart showing signals during typical pulse number control.
Figure 10:
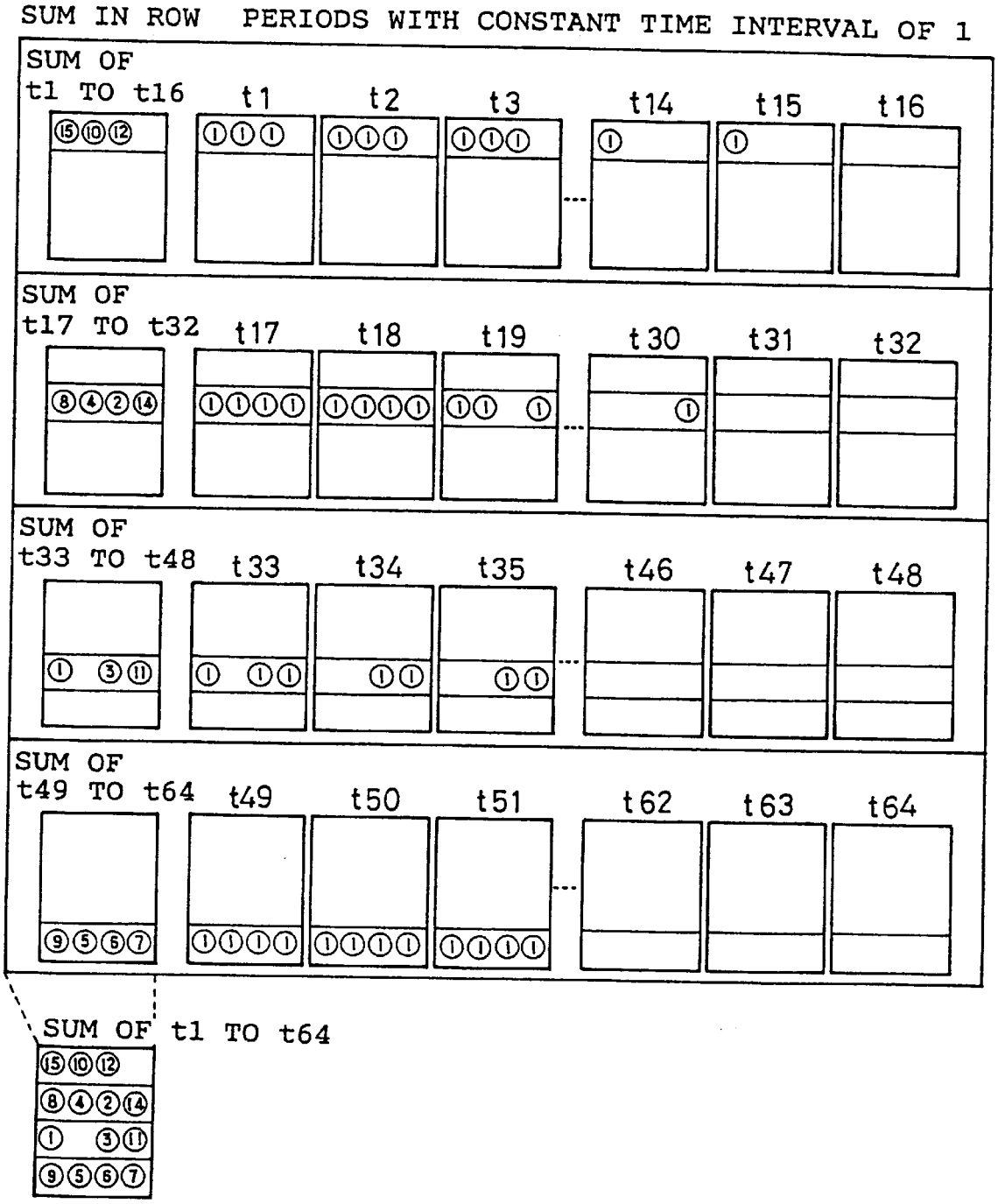
FIG. 10 (PRIOR ART)
FIG. 10 is an explanatory view showing ON states of display elements for each period of each unit time.
Figure 11:
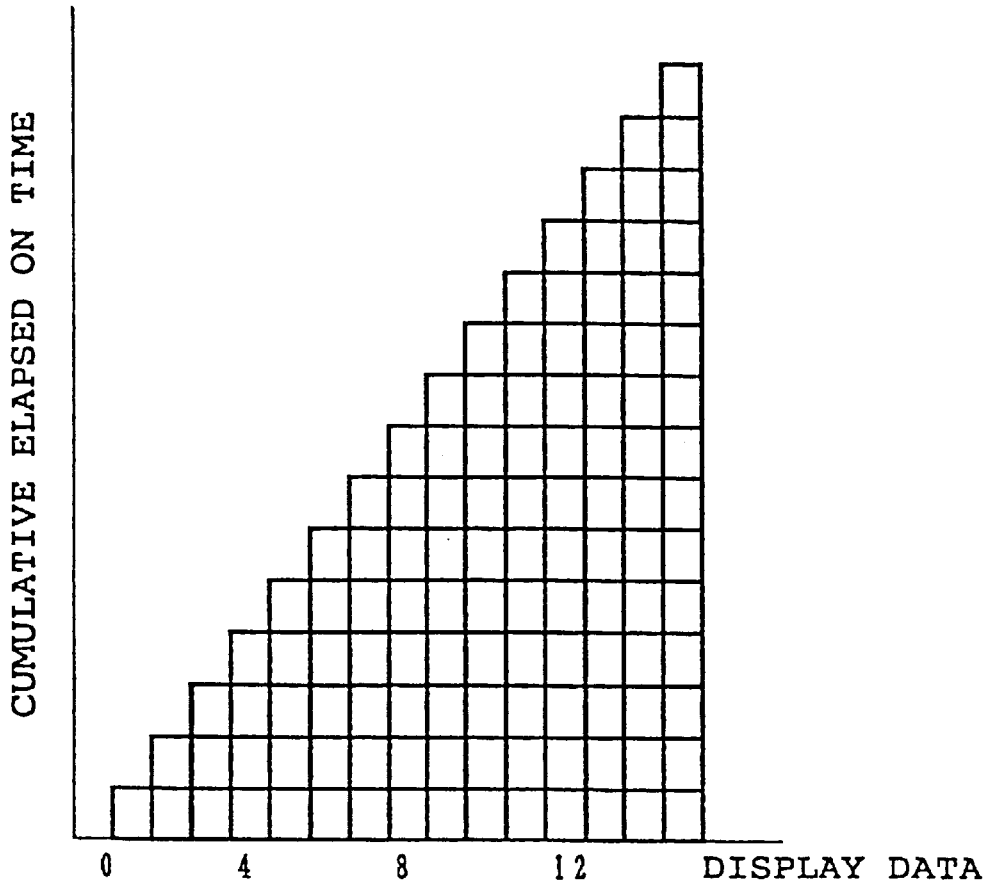
FIG. 11 (PRIOR ART)
FIG. 11 is an explanatory view showing a relationship between display data and a cumulative elapsed ON time during the pulse number control.
Figure 12:
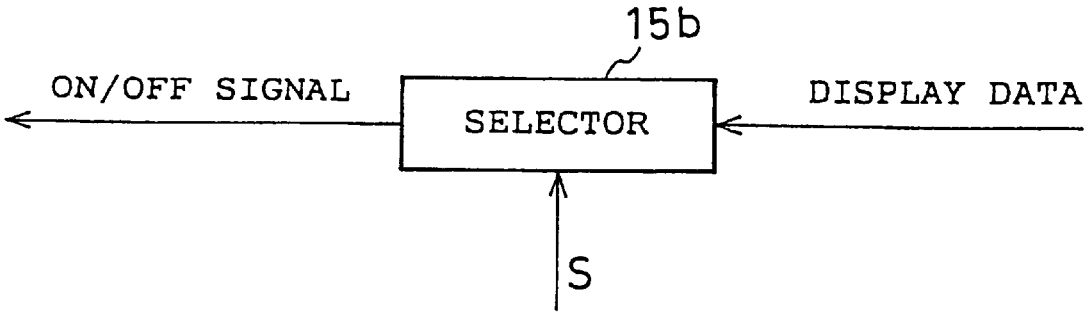
FIG. 12 (PRIOR ART)
FIG. 12 is a block diagram showing an illustrative changing portion in a display unit in which pulse width control is made.
Figure 13:
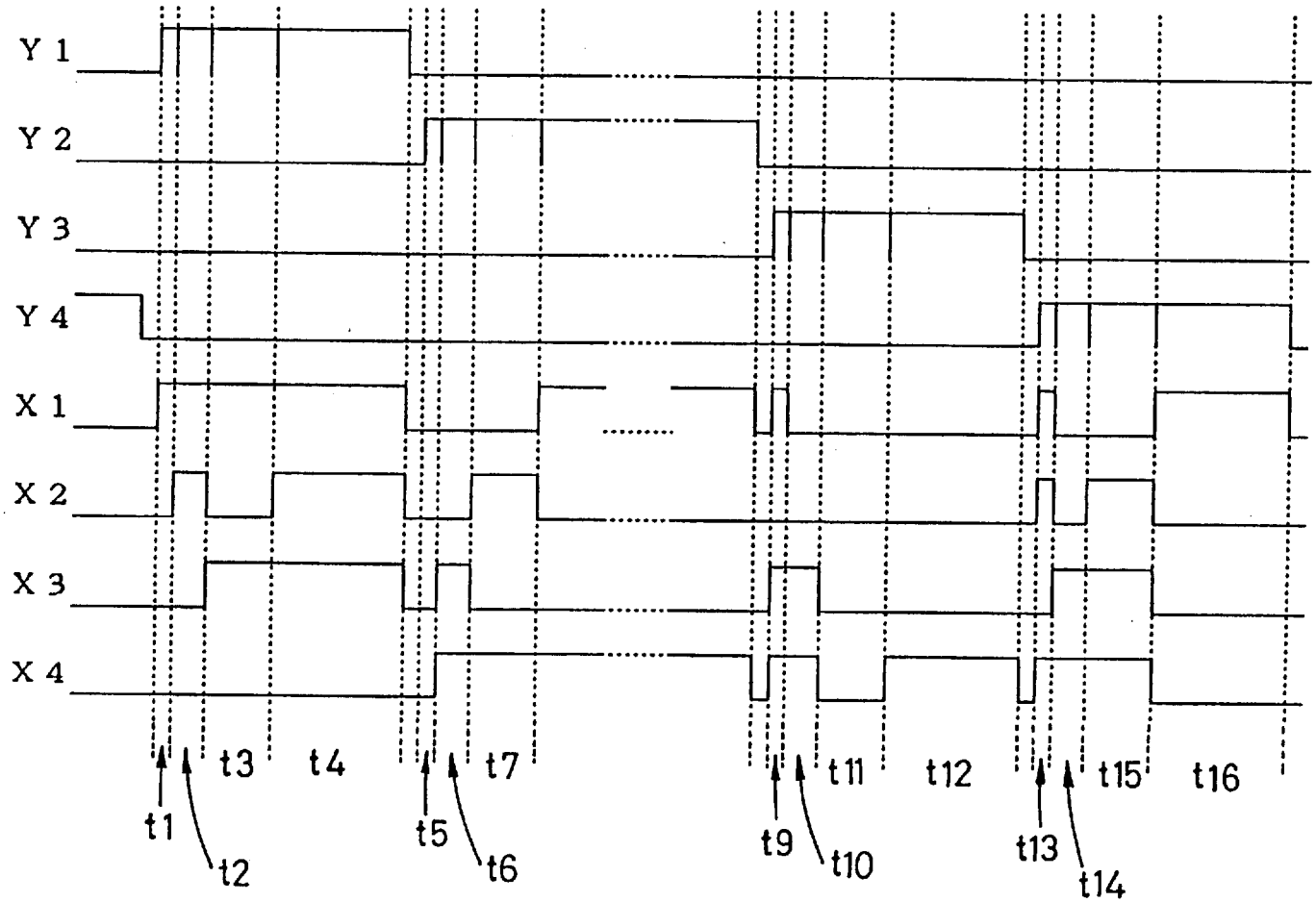
FIG. 13 (PRIOR ART)
FIG. 13 is a time chart showing signals during typical pulse width control.
Figure 14:
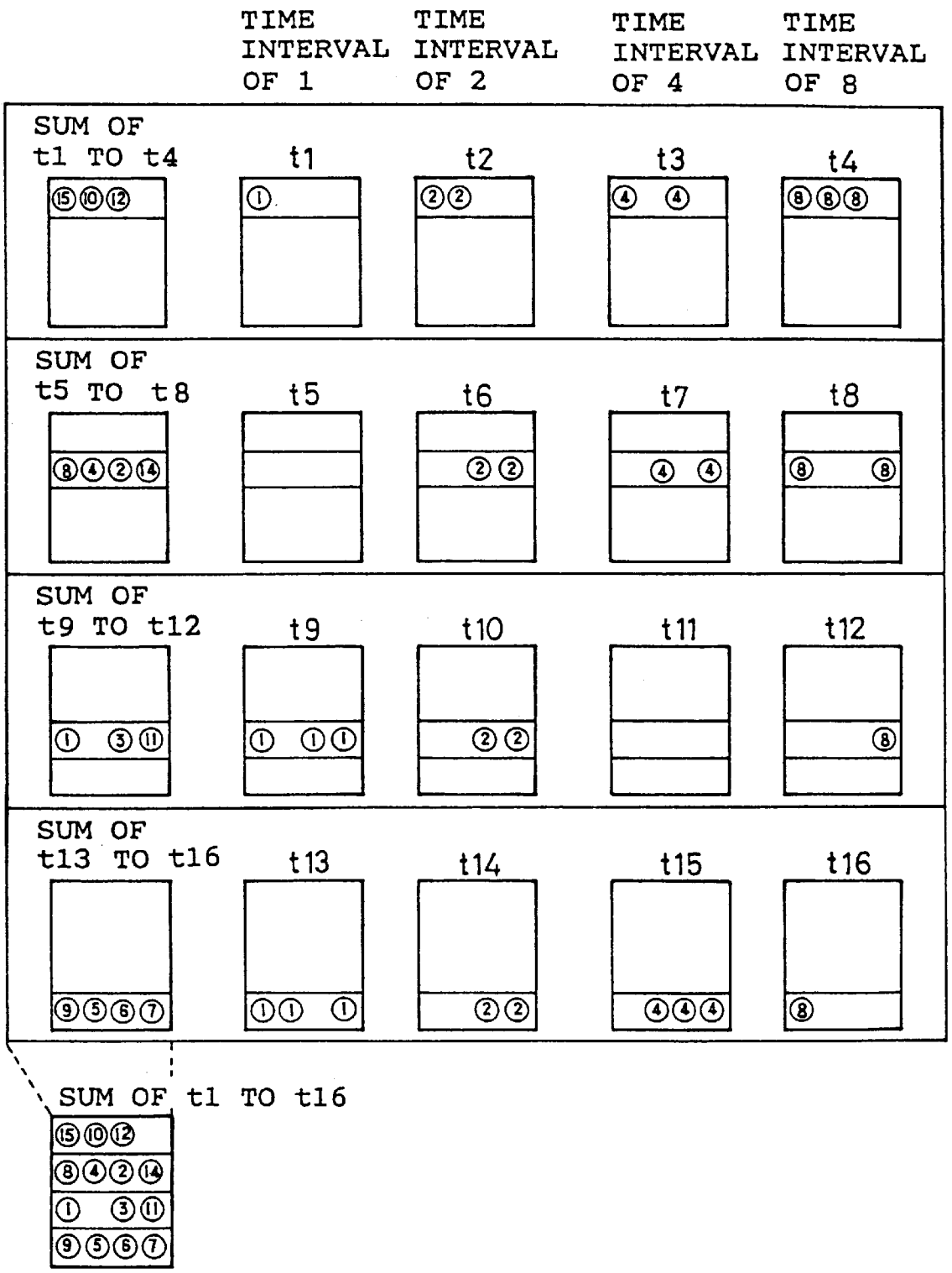
FIG 14 (PRIOR ART)
FIG. 14 is an explanatory view showing ON states of display elements for each period of each unit time.
Figure 15:
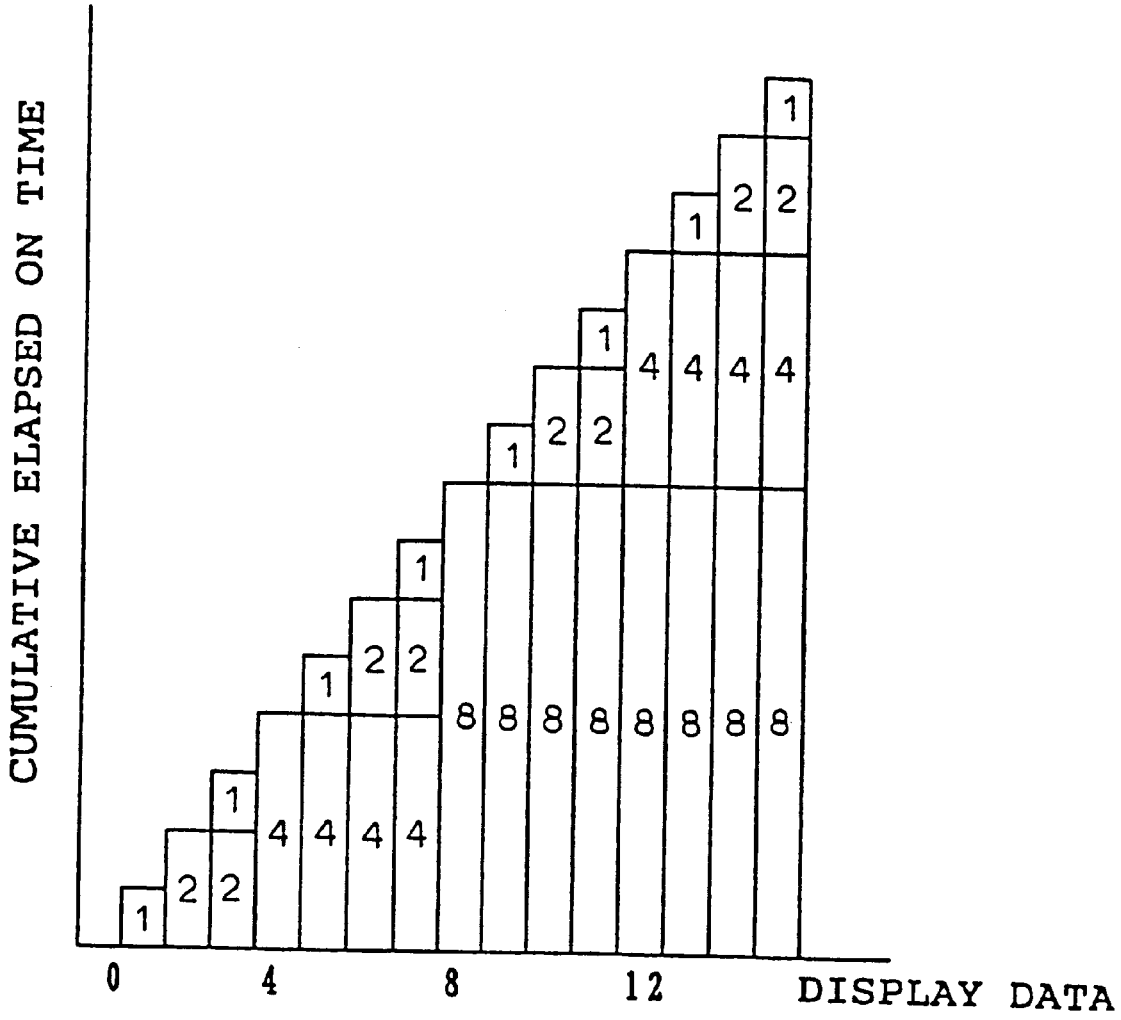
FIG. 15 (PRIOR ART)
FIG. 15 is an explanatory view showing a relationship between display data and a cumulative elapsed ON time during the pulse width control.

A description will now be given of the operation. For the sake of simplicity of the following discussion, the description will be given of the matrix display panel 1 having elements including a 4-by-4 pixel array. Here, one display data is set to have a 4-bit structure, and a relationship of display pixels and the memory shown in FIGS. 3 to 5 is used as one example.

The display control unit 9 outputs the display data, addresses corresponding to positions at which the display data are displayed, and a timing signal in synchronization with the display data. The timing signal is inputted into the read/write control circuit 11. After the input of the timing signal, the read/write control circuit 11 outputs a signal by which the selector is switched over to a write address. Therefore, a display address from the display control unit 9 is fed to the memory 7 as the write address. As a result, the display data is stored in the memory 7 at an area specified by the write address.

In order to display an image depending upon the display data in the memory 7, in the changing portion 151, the comparator 151*a* receives as input two higher order bits in the display data, and the selector 151*b* receives as input two lower order bits in the display data. In this case, the select signal S1 is a 1-bit signal.

Figure 18:
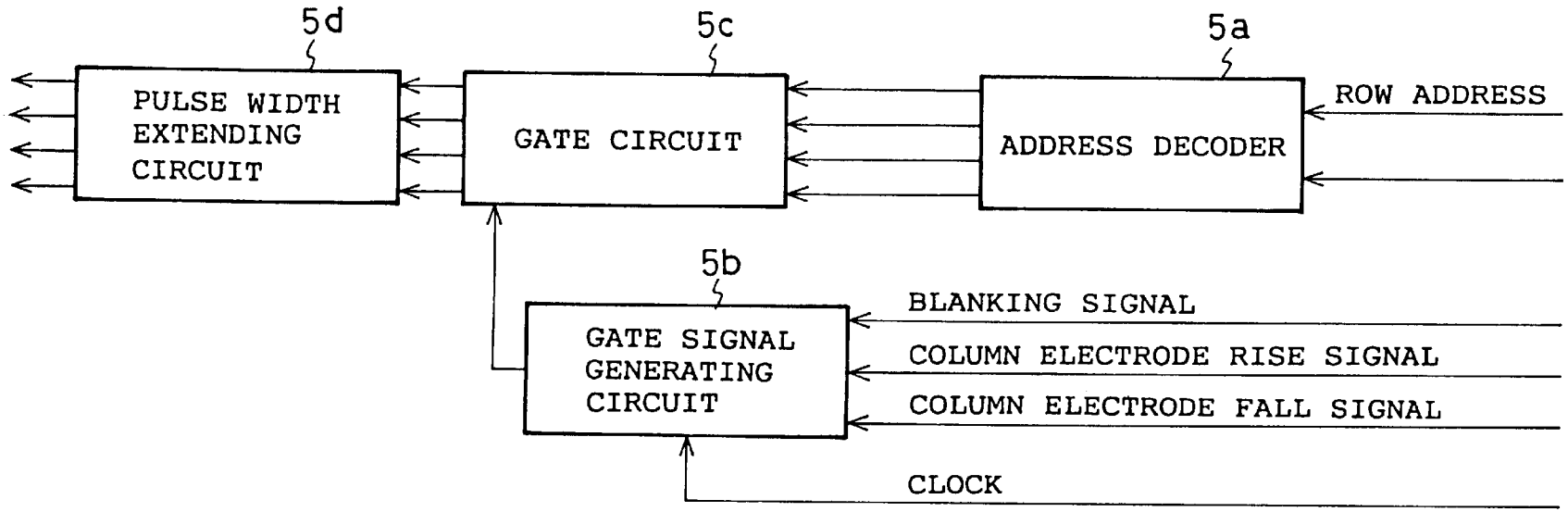
FIG. 18 is a block diagram showing a detailed structure of a row electrode control circuit.

FIG. 18 is a block diagram showing a detailed structure of the row electrode control circuit 51. In the drawing, reference numeral 5*a* denotes an address decoder to decode a Y address created in the read address counter 131 so as to provide a fundamental waveform. Reference numeral 5*b* denotes a gate signal generating circuit to create a gate signal according to a blanking signal, a column electrode rise signal, a column electrode fall signal, and a clock signal, and 5*c* is a gate circuit to transform the fundamental waveform according to the gate signal outputted from the gate signal generating circuit. The gate circuit 5*c* notches the fundamental waveform such that the row electrode can be set in an OFF state at a rise or fall time of a signal applied to the column electrode (X electrode), and such that the signal applied to the column electrode can have a pulse width of a time interval of 1 or a time interval of 2. Reference numeral 5*d* denotes a pulse width extending circuit to extend a pulse width so as to compensate a rise delay time of the driver 2, or a delay time from supply of signal to the display element to emission of the display element.

Figures 19, 20:
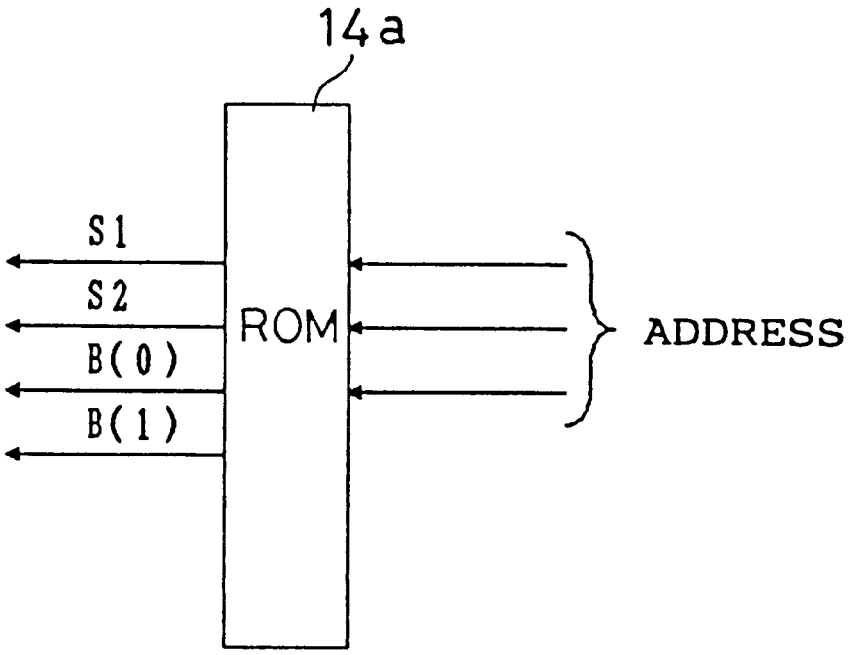
FIG. 19 is a block diagram showing one illustrative structure of a changing control circuit in FIG. 1.
FIG. 20 is an explanatory view showing a table stored in a ROM (read-only memory) shown in FIG. 19.

FIG. 19 is a block diagram showing one illustrative structure of the changing control circuit 141 in a display unit for the 16-scale image including the 4-by-4 pixel array. In this illustration, the changing control circuit 141 includes a ROM (read-only memory) 14*a*. A table as shown in FIG. 20 is stored in the ROM 14*a*. Further, the read address counter 131 feeds the ROM 14*a* with a 3-bit address which is sequentially incremented from zero to four, and the ROM 14*a* outputs the select signal S1, the select signal S2, and the comparison signal B as shown in FIG. 20 according to the inputted address. In FIG. 20, the mark X denotes signals which are not used in the embodiment.

Figure 21:
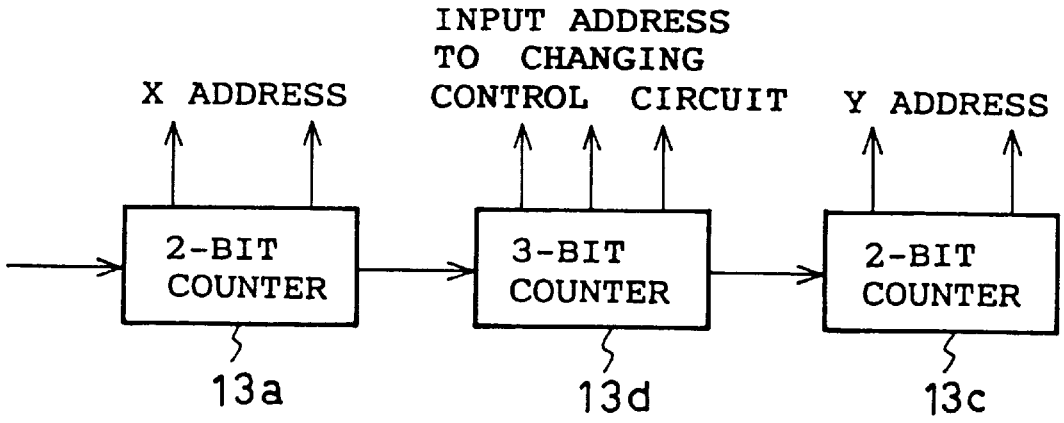
FIG. 21 is a block diagram showing a detailed structure of a read address counter.

FIG. 21 is a block diagram showing a structure of the read address counter 131. In this case, the read address counter 131 includes a 2-bit counter 13*a* for generating an X address, a 3-bit counter 13*d* for generating an address supplied to the changing control circuit 141, and a 2-bit counter 13*c* for generating the Y address. The 2-bit counter 13*a* counts a clock signal from the read/write control circuit 11 so as to sequentially output values of zero to three corresponding to the column electrodes $X_1$ to $X_4$. The 3-bit counter 13*d* counts a carry signal of the 2-bit counter 13*a*. In the 3-bit counter 13*c*, an initial value is set to zero, and a count value is reset to zero after the value reaches four. The 2-bit counter 13*c* counts a carry signal of a 4-bit counter 13*b*. In the 2-bit counter 13*c*, an initial value is set to zero corresponding to a row electrode $Y_1$.

The display data is read out from the memory 7 according to the X address and the Y address from the read address counter 131. The X address indicates two lower order bits in a memory address, and the Y address indicates two higher order bits in the memory address. As shown in FIG. 17, the read display data is divided in the changing portion 151 into the two higher order bits and the two lower order bits. Data including the two higher order bits is defined as AU.

First, display data in the first row, that is, the display data at addresses "0," "1," "2," and "3" are sequentially read out from the memory 7. During the operation, the address "0" is supplied to the changing control circuit 141. Consequently, the changing control circuit 141 outputs the contents at the address "0" in the ROM 14*a*, that is, outputs the select signal S1 of zero and the select signal S2 of zero.

Figure 22:
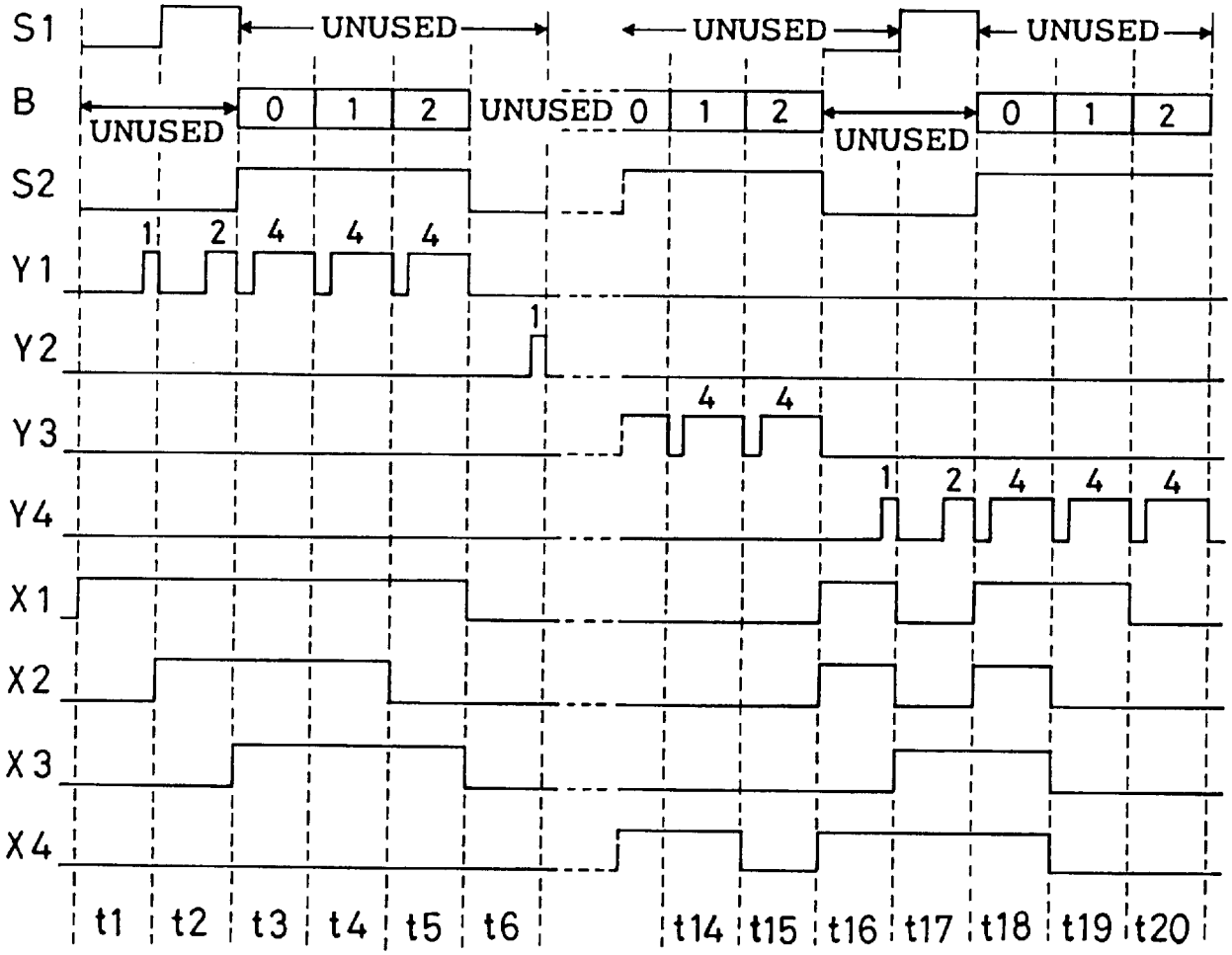
FIG. 22 is a time chart showing a select signal, a comparison signal, signals fed to row electrodes, and signals fed to column electrodes in the display unit.

In the changing portion 151, because of S1=0, the selector 151*b* selects the least significant bits in the display data which are sequentially inputted. Further, because of S2=0, the selector 151*c* selects output of the selector 151*b* so as to sequentially output the result of selection to the shift register 4. Data set in the shift register 4 are latched by the column electrode control circuit 6 according to the latch signal from the timing generating circuit 81. A signal from the column electrode control circuit 6 is applied to the column electrodes $X_1$ to $X_4$ through the driver 3. It can be seen that operation shown by reference numerals X1 to X4 for a period t1 in a timing chart of FIG. 22 are carried out as set forth above. Since the first row sequentially contains data of "15 (in decimal notation)," "10 (in decimal notation)," "12 (in decimal notation)," and "0" (see FIG. 5), signals respectively corresponding to one, zero, zero, and zero are applied to the column electrodes $X_1$ to $X_4$.

During the operation, the Y address is kept zero. Hence, in the row electrode control circuit 51, the address decoder 5*a* places a square wave, as the fundamental waveform, on an output line corresponding to the first row in the matrix display panel 1. Further, the row electrode control circuit 51 receives as input a blanking signal indicating that a former three-quarters of the period t1 is defined as a blanking period. It is possible to create such a blanking signal by, for example, using a signal in the read address counter 131. That is, in a period in which an address fed to the changing control circuit 141 indicates zero, the period having the X address indicating "0," "1," or "2" may be defined as the blanking period.

Figure 23:
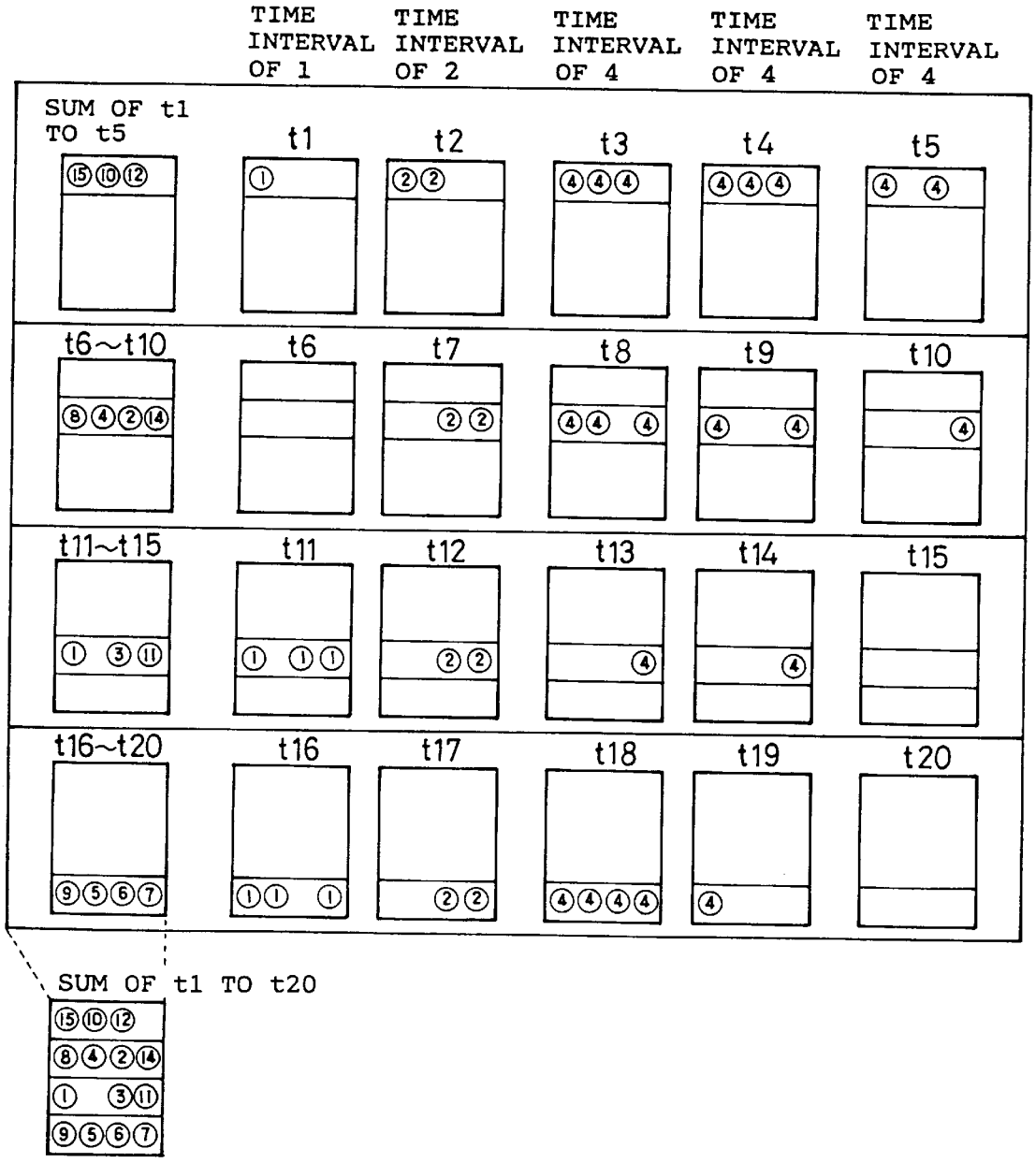
FIG. 23 is an explanatory view showing ON states of pixels for each period of each unit time.

The gate signal generating circuit 5*b* creates a gate signal according to the blanking signal so as to feed the gate signal to the gate circuit 5*c*. The gate circuit 5*c* transforms the fundamental waveform from the address decoder 5*a* according to the gate signal so as to apply the transformed signal to the row electrode $Y_1$ through the driver 2. Thus, a signal shown by reference numeral Y1 for the period t1 in FIG. 22 is applied to the row electrode $Y_1$. That is, for the period t1, the row electrode $Y_1$ is driven for a period corresponding to a time interval of 1. Periods t1 to t20 are respectively provided with a time interval of 5. Hence, as shown in the period t1 in the first row in FIG. 23, substantially for the periods t1, a display element corresponding to the address "0" in the memory 7 is exclusively held ON for a time interval of 1.

Subsequently, in the 3-bit counter 13*d* in the read address counter 131, a count value is set to one. From the memory 7, display data at addresses "0." "1," "2," and "3" are sequentially read out. During the operation, the address "1" is supplied to the changing control circuit 141. Consequently, the changing control circuit 141 outputs the contents at the address "1" in the ROM 14*a*. That is, the changing control circuit 141 outputs the select signal SI of one and the select signal S2 of zero.

In the changing portion 151, because of S1=1, the selector 151*b* selects the second least significant bits of the display data which are sequentially inputted. Further, because of S2=0, the selector 151*c* selects output of the selector 151*b* so as to sequentially output the result of selection to the shift register 4. It can be seen that operation shown by reference numerals Xl to X4 for a period t2 in the timing chart of FIG. 22 are carried out as set forth above. That is, since the first row sequentially contains the data of "15 (in decimal notation)," "10 (in decimal notation)," "12 (in decimal notation)," and "0" (see FIG. 5), signals respectively corresponding to one, one, zero, and zero are applied to the column electrodes $X_1$ to $X_4$.

During the operation, the Y address is kept zero. Hence, in the row electrode control circuit 51, the address decoder 5*a* places the square wave, as the fundamental waveform, on the output line corresponding to the first row in the matrix display panel 1. Further, the row electrode control circuit 51 receives as input a blanking signal indicating that a first half of the period t2 is defined as the blanking period. It is possible to create such a blanking signal by, for example, using a signal in the read address counter 131. That is, in a period in which an address fed to the changing control circuit 141 indicates one, the period having the X address indicating "0" or "1" may be defined as the blanking period.

The gate signal generating circuit 5*b* creates the gate signal according to the blanking signal so as to feed the gate signal to the gate circuit 5*c*. The gate circuit 5*c* transforms the fundamental waveform from the address decoder 5*a* according to the gate signal so as to apply the transformed signal to the row electrode $Y_1$ through the driver 2. Thus, a signal shown by reference numeral $Y_1$ for the period t2 in FIG. 22 is applied to the row electrode $Y_1$. That is, for the periods t2, the row electrode $Y_1$ is driven for a period corresponding to a time interval of 2. Hence, as shown in the period t2 in the first row in FIG. 23, substantially for the period t2, display elements corresponding to the addresses "0" and "1" in the memory 7 are held ON for a time interval of 2.

Subsequently, in the 3-bit counter 13*d* in the read address counter 131, a count value is set to two. From the memory 7, display data at addresses "0," "1," "2," and "3" are sequentially read out. During the operation, the address "2" is supplied to the changing control circuit 141. Consequently, the changing control circuit 141 outputs the contents at the address "2" in the ROM 14*a*. That is, the changing control circuit 141 outputs the select signal S2 of one and the comparison signal B of zero. The display data to be inputted sequentially include "15 (in decimal notation)," "10 (in decimal notation)," "12 (in decimal notation)," and "0" (see FIGS. 5 and 6). In the changing portion 151, because of B=0, the comparator 151*a* compares the two higher order bits AU in the display data which are sequentially inputted, with zero. The comparator 151*a* outputs an ON signal when AU is greater than B, or outputs an OFF signal when AU is less than or equal to B. If a value indicated by the two higher order bits is greater than zero, the comparator 151*a* outputs one. Therefore, the comparator 151*a* sequentially outputs one, one, one, and zero. Further, because of S2=1, the selector 151*c* selects output of the comparator 151*a* so as to sequentially output the result of selection to the shift register 4. It can be seen that operation shown by reference numerals X1 to X4 for a period t3 in the timing chart of FIG. 22 are carried out as set forth above. That is, signals corresponding to one, one, one, and zero are applied to the column electrodes $X_1$ to $X_4$.

During the operation, the Y address is kept zero. Hence, in the row electrode control circuit 51, the address decoder 5*a* places the square wave, as the fundamental waveform, on the output line corresponding to the first row in the matrix display panel 1. Further, the row electrode control circuit 51 receives as input a blanking signal indicating that a former quarter of the period t3 is defined as the blanking period. It is possible to create such a blanking signal by, for example, using a signal in the read address counter 131. That is, in a period in which an address fed to the changing control circuit 141 indicates two, the period having the X address indicating "0" may be defined as the blanking period.

The gate signal generating circuit 5*b* creates the gate signal according to the blanking signal so as to feed the gate signal to the gate circuit 5*c*. The gate circuit 5*c* transforms the fundamental waveform from the address decoder 5*a* according to the gate signal so as to apply the transformed signal to the row electrode $Y_1$ through the driver 2. Thus, a signal shown by reference numeral Y1 for the period t3 in FIG. 22 is applied to the row electrode $Y_1$. That is, for the periods t3, the row electrode $Y_1$ is driven for a period corresponding to a time interval of 4. Hence, as shown in the period t3 in the first row in FIG. 23, substantially for the period t3, display elements corresponding to the addresses "0," "1," and "2" in the memory 7 are held ON for a time interval of 4.

Subsequently, in the 3-bit counter 13*d* in the read address counter 131, a count value is set to three. From the memory 7, display data at addresses "0," "1," "2," and "3" are sequentially read out. During the operation, the address "3" is supplied to the changing control circuit 141. Consequently, the changing control circuit 141 outputs the contents at the address "3" in the ROM 14*a*. That is, the changing control circuit 141 outputs the select signal S2 of one and the comparison signal B of one. The display data to be inputted sequentially include "15 (in decimal notation)," "10 (in decimal notation)," "12 (in decimal notation)," and "0" (see FIGS. 5 and 6).

In the changing portion 151, because of B=1, the comparator 151*a* compares the two higher order bits in the display data which are sequentially inputted, with one. If a value indicated by the two higher order bits is greater than one, the comparator 151*a* outputs one. Therefore, the comparator 151*a* sequentially outputs one, one, one, and zero. Further, because of S2=1, the selector 151*c* selects output of the comparator 151*a* so as to sequentially output the result of selection to the shift register 4. It can be seen that operation shown by reference numerals X1 to X4 for a period t4 in the timing chart of FIG. 22 are carried out as set forth above. That is, signals corresponding to one, one, one, and zero are applied to the column electrodes $X_1$ to $X_4$.

During the operation, the Y address is kept zero. Hence, in the row electrode control circuit 51, the address decoder 5*a* places the square wave, as the fundamental waveform, on the output line corresponding to the first row in the matrix display panel 1. Further, the row electrode control circuit 51 receives as input a blanking signal indicating that a former quarter of the period t4 is defined as the blanking period. It is possible to create such a blanking signal by, for example, using a signal in the read address counter 131. That is, in a period in which an address fed to the changing control circuit 141 indicates three, the period having the X address indicating "0" may be defined as the blanking period.

The gate signal generating circuit 5*b* creates the gate signal according to the blanking signal so as to feed the gate signal to the gate circuit 5*c*. The gate circuit 5*c* transforms the fundamental waveform from the address decoder 5*a* according to the gate signal so as to apply the transformed signal to the row electrode $Y_1$ through the driver 2. Thus, a signal shown by reference numeral Y1 for the period t4 in FIG. 22 is applied to the row electrode $Y_1$. That is, for the periods t4, the row electrode $Y_1$ is driven for a period corresponding to the time interval of 4. Hence, as shown in the period t4 in the first row in FIG. 23, substantially for the period t4, the display elements corresponding to the addresses "0," "1," and "2" in the memory 7 are held ON for the time interval of 4.

Subsequently, in the 3-bit counter 13*d* in the read address counter 131, a count value is set to four. From the memory 7, display data at addresses "0," "1," "2," and "3" are sequentially read out. During the operation, the address "4" is supplied to the changing control circuit 141. Consequently, the changing control circuit 141 outputs the contents at the address "4" in the ROM 14*a*. That is, the changing control circuit 141 outputs the select signal S2 of one and the comparison signal B of two (in decimal notation). The display data to be inputted sequentially include "15 (in decimal notation)," "10 (in decimal notation)," "12 (in decimal notation)," and "0" (see FIGS. 5 and 6).

In the changing portion 151, because of B=2, the comparator 151*a* compares the two higher order bits in the display data which are sequentially inputted, with two. If a value indicated by the two higher order bits is greater than two, the comparator 151*a* outputs one. Therefore, the comparator 151*a* sequentially outputs one, zero, one, and zero. Further, because of S2=1, the selector 151*c* selects output of the comparator 151*a* so as to sequentially output the result of selection to the shift register 4. It can be seen that operation shown by reference numerals X1 to X4 for a period t5 in the timing chart of FIG. 22 are carried out as set forth above. That is, signals corresponding to one, zero, one, and zero are applied to the column electrodes $X_1$ to $X_4$.

During the operation, the Y address is kept zero. Hence, in the row electrode control circuit 51, the address decoder 5*a* places the square wave, as the fundamental waveform, on the output line corresponding to the first row in the matrix display panel 1. Further, the row electrode control circuit 51 receives as input a blanking signal indicating that a former quarter of the period t5 is defined as the blanking period. It is possible to create such a blanking signal by, for example, using a signal in the read address counter 131. That is, in a period in which an address fed to the changing control circuit 141 indicates four, the period having the X address indicating "0" may be defined as the blanking period.

The gate signal generating circuit 5*b* creates the gate signal according to the blanking signal so as to feed the gate signal to the gate circuit 5*c*. The gate circuit 5*c* transforms the fundamental waveform from the address decoder 5*a* according to the gate signal so as to apply the transformed signal to the row electrode $Y_1$ through the driver 2. Thus, a signal shown by reference numeral Y1 for the period t5 in FIG. 22 is applied to the row electrode $Y_1$. That is, for the periods t5, the row electrode $Y_1$ is driven for a period corresponding to the time interval of 4. Hence, as shown in the period t5 in the first row in FIG. 23, substantially for the period t5, the display elements corresponding to the addresses "0," "1," and "2" in the memory 7 are held ON for the time interval of 4.

Here, the above processing is defined as one field processing. During the one field processing, as shown at the leftmost end of the first row in FIG. 23, the display element corresponding to the address "0" is held ON for a period of 15 unit times, the display element corresponding to the address "1" is held ON for a period of 10 unit times, and the display element corresponding to the address "2" is held ON for a period of 12 unit times.

Thereafter, in the 2-bit counter 13*a* for outputting the X address and the 3-bit counter 13*d* for outputting the address to the changing control circuit 141, count values are reset to zero. Further, in the 2-bit counter 13*c* for outputting the Y address, the count value is set to one. Consequently, the above processing is carried out for each display data in the second row, that is, for each display data at the addresses "4" to "7" in the memory 7. Further, the above processing is similarly carried out for each display data in the third row and in the fourth row.

In this case, the number of scale is 16 ($=2^4$), and the exponent or index is 4. The number of times expressed as [(exponent or index/2)+[the (exponent or index/2)th power of 2]−1] denotes $2+2^2-1=5$. Accordingly, the display data are read out from the memory 7 five times.

Figure 24:
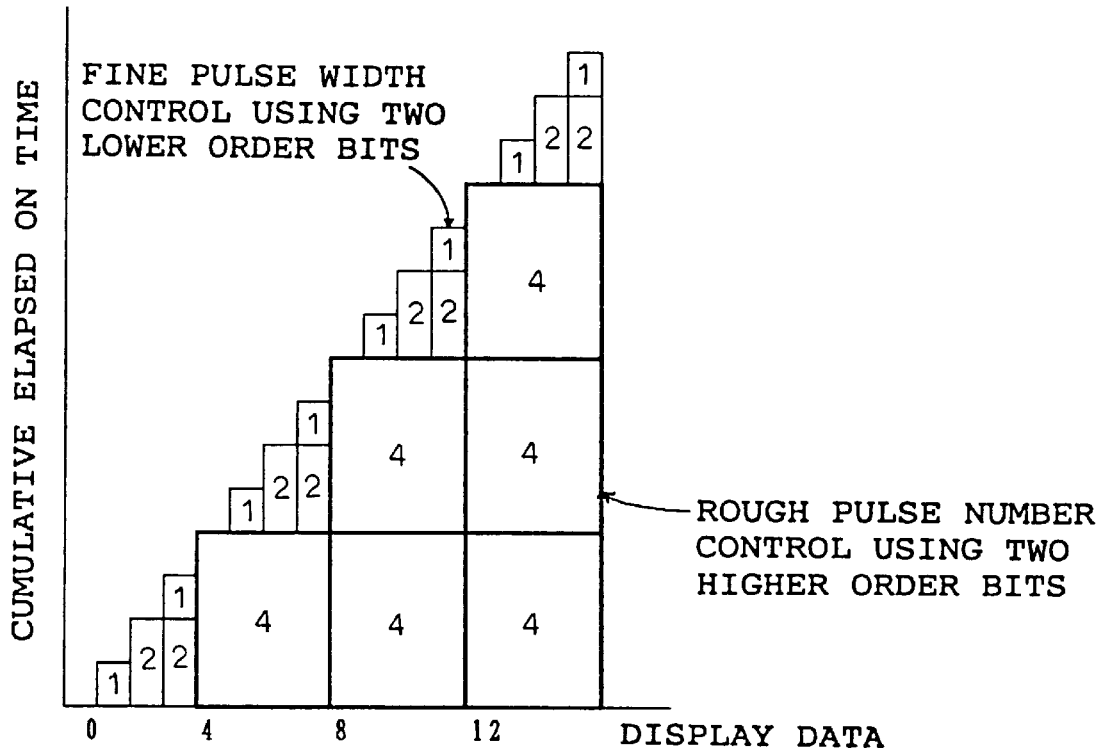
FIG. 24 is an explanatory view showing a relationship between display data and a cumulative elapsed ON time.

The above-mentioned processing can be summarized as follows. As shown in FIG. 24, fine gray scale control can be made depending upon the two lower order bits in the display data according to the pulse width control method, and rough gray scale control can be made depending upon the two higher order bits in the display data according to the pulse number control method.

For example, when display is realized depending upon the ON signal having the time interval of 1 and the ON signal having the time interval of 2, as shown in FIG. 22, drive signals for the column electrodes $X_1$ to $X_4$ are set to have the time interval of 5. Further, drive signals for the row electrodes $Y_1$ to $Y_4$ are set to have a time interval of 1 and a time interval of 2. Those are shown in, for example, periods t1 and t2 in FIG. 22. As a result, the display elements are held ON for the time intervals of 1 and 2, and are not turned ON for other time intervals, that is, for the blanking time. The blanking time further extends a cycle to drive the column electrodes $X_1$ to $X_4$, and extends a cycle to read from the memory 7. It is necessary to read out data from the memory 7 within the time interval of 1 in the conventional pulse width control method. However, in this case, the data may be read out from the memory 7 within the time interval of 5.

As set forth above, in the display unit, the display data from the memory 7 is divided into the two higher order bits and the two lower order bits so as to be inputted into the changing portion 151. In the changing portion 151, control using the two higher order bits, i.e., the rough gray scale control is implemented according to the pulse number control method, and control using the two lower order bits, i.e., the fine gray scale control is implemented according to the pulse width control method in which the ON signals are outputted for each period according to weight of each bit. In the rough gray scale control, since an additional ON signal is provided according to an increase in a value indicated by the display data, the value of the display data can be made proportional to brightness of the panel. On the other hand, in the fine gray scale control, the ON signals having different pulse widths are combined so that the number of times the data is read from the memory can be reduced. Therefore, the value of the display data can be made substantially proportional to the brightness of the panel. Further, as is apparent from FIG. 22, the periods t1 to t20 have a constant time interval. Thus, even when the ON signal having the time interval of 1 is used as in the periods t1, it is possible to ensure a sufficient time interval to read out the display data from the memory 7. That is, a high speed memory is not required as the memory 7.

As shown in FIG. 18, in the row electrode control circuit 51, the address decoder 5*a* decodes the Y address created in the read address counter 131 so as to provide a fundamental waveform. Further, the gate circuit 5*c* notches the fundamental waveform such that the row electrodes can be set in the OFF state at the time of rise or fall of the signals applied to the column electrodes $X_1$ to $X_4$, or such that the signals applied to the column electrodes can have the pulse width of the time interval of 1 or the time interval of 2.

An increase in the number of gray scale reduces a permissible time interval for the ON signal. If the time interval of the ON signal is less than a rise delay time of the driver 2, or a total delay time from supply of signal to the light emitting elements to emission of the light emitting elements, the light emitting elements can not be driven. That is, the light emitting elements can not be turned ON even when the ON signal is supplied. Hence, the pulse width extending circuit 5*d* may be used to extend a pulse width of the signal outputted from the gate circuit 5*c* so as to compensate the rise delay time of the driver 2 at a subsequent stage, or the delay time from supply of signal to the light emitting elements to the emission of the light emitting elements. Alternatively, a delay time caused by the time the signal reaches the row electrode control circuit 51 may be compensated.

Figure 25:
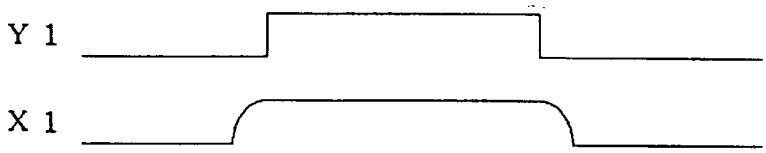
FIG. 25 is an explanatory view showing a, relationship between a signal fed to a row electrode and a signal fed to a column electrode.

Alternatively, as shown in FIG. 25, output of the row electrode control circuit 51 may be compensated such that signals applied to the row electrodes are set in an OFF state during rise and fall operations of signals applied to the driver 3 for the column electrodes. The compensation processing is implemented according to the column electrode rise signal and the column electrode fall signal shown in FIG. 18. This processing can prevent a response velocity of the column electrode drive circuit from having an effect on a display image.

Though a description has been given of the 16-scale gray image, the circuit shown in FIG. 16 can implement, for example, 256-scale image display. In order to implement the 256-scale image display in the conventional pulse number control method, the respective display data must be read out 256 times from the memory 7 before one frame can be displayed. Thus, it is necessary to employ a more rapid memory 7 and so forth. On the other hand, in order to implement the 256-scale image display in the conventional pulse width control method, the respective display data must be read out 8 times from the memory 7 before the one frame can be displayed. Thus, it is necessary to employ a more rapid memory 7 and so forth. Though the pulse width control method has an advantage of a less number of times of read, the value indicated by the display data can not easily be made proportional to the brightness of a screen.

In contrast with this, according to the control of the present invention, for the 256-scale image display, the display data may be read out only 19 times from the memory 7 before the one frame can be displayed. That is, the display data are read out once for the time interval of 1, once for the time interval of 2, once for the time interval of 4, once for the time interval of 8, and 15 times for the time interval of 16, resulting in 19 times. In this case, the number of gray scale can be expressed as $256=2^8$, and the exponent or index is 8. Therefore, the number of times expressed as [(exponent or index/2)+[the (exponent or index/2)th power of 2]−1] denotes $4+2^4-1=19$. Accordingly, the value indicated by the display data can easily be made proportional to the brightness of display a relatively smaller number of times of read than that in the conventional pulse number control method.

What is claimed is:

1. A display unit comprising:

a matrix display panel including display elements disposed at intersections of a group of row electrodes and a group of column electrodes;

a memory in which display data is stored;

a changing portion for generating an ON/OFF signal, wherein said ON/OFF signal is generated for lower order bits in each display data read from the memory with reference to a value of each of the lower order bits, and wherein said ON/OFF signal is generated for higher order bits by comparing a value indicated by the higher order bits with a predetermined value so as to output an ON signal when the value indicated by the bits is greater than the predetermined value;

a column electrode control circuit for applying voltage to the group of column electrodes of the matrix display panel according to the ON/OFF signal from the changing portion; and a row electrode control circuit for applying row voltage to the group of row, electrodes of the matrix display panel.

2. A display unit according to claim 1, wherein the row electrode control circuit includes a gate circuit for outputting each row voltage which is held ON for a period corresponding to a weight of each lower order bit in the display data when the column electrode control circuit applies voltage to the group of column electrodes according to the ON/OFF signal for the lower order bits in the display data, and for outputting row voltage which is held ON for a period corresponding to a value obtained by duplicating a maximum value among the weights of the lower order bits when the column electrode control circuit applies voltage to the group of column electrodes according to an ON/OFF signal for tie higher order bits in the display data.

3. A display unit according to claim 1, further comprising a read address counter for reading out the same display data from the memory a number of times (N) defined by $N=(E/2+2^{(E/2)}-1)$, where $2^E$ is a number of gray scales provided by the display unit and E is an integer index value.

4. A display unit according to claim 1, further comprising a changing control circuit for feeding the changing portion with a select signal indicating whether processing should be carried out for higher order bits or for lower order bits of the display data, and for feeding the changing portion with said predetermined value with which the value indicated by the higher order bits in the display data is compared.

5. A display unit according to claim 3, wherein the read address counter allows display data to be outputted from the memory at a constant cycle.

6. A display unit according to claim 1, wherein the row electrode control circuit outputs row voltage whose rise portion is set in an OFF state for each cycle.

7. A display unit according to claim 1, wherein the row electrode control circuit includes a pulse width extending circuit for extending a time interval of an ON signal by a rise delay time of a driver for the matrix display panel, or by a response delay time of a display element.

8. A display unit according to claim 1, wherein the row electrode control circuit.

9. A display unit according to claim 4, further comprising a read address counter for reading out the same display data from the memory a number of times (N) defined by $N=(E/2+2^{(E/2)}-1)$, where $2^E$ is a number of gray scales provided by the display unit and E is an integer index value.

10. The display unit according to claim 4, wherein said changing control circuit further supplies a lower order bit specification signal to said changing portion for selecting one bit from said lower order bits.

11. The display unit according to claim 10, wherein said changing control circuit comprises a look-up table for outputting said select signal, said predetermined value for comparison, and said lower order bit specification signal to said changing portion on the basis of an input address signal.

12. The display unit according to claim 1, further including a look-up table for outputting a signal to said changing portion which instructs said changing portion to use said lower order bits to generate said ON/OFF signal, or use said higher order bits to generate said ON/OFF signal.

13. A display unit including:

a matrix display panel including a plurality of display elements driven by ON/OFF signals according to display data stored in a memory;

a changing portion for generating said ON/OFF signals for said matrix display panel, wherein said changing portion comprises:

a first unit for generating ON/OFF signals on the basis of lower order bits of said display data;

a second unit for generating ON/OFF signals on the basis of higher order bits of said display data;

a third unit for selecting whether output of said changing portion is determined by said first unit or said second unit;

a changing control circuit for controlling said changing portion.

14. The display unit of claim 13, wherein second unit provides ON/OFF signals to affect rough control of said max display panel using a pulse number display technique, and where said first unit provides ON/OFF signals to affect fine control of said matrix display panel using a pulse width display technique.

15. The display unit of claim 13, wherein said changing control circuit comprises a look-up table which supplies signals to said changing portion as a function of address signals.

16. The display unit of claim 13, wherein said changing control circuit provides a selection signal to said third unit for selecting whether said output of said changing portion is determined by said first unit or said second unit.

17. The display unit of claim 13, wherein said changing control circuit provides a comparison signal to said second unit, and said second unit compare said higher order bits with said comparison signal to generate said ON/OFF signals.

18. The display unit of claim 13, wherein said changing control circuit provides a lower bit selection signal to said first unit, and said first unit uses said lower bit selection unit to select one of said lower bits.

* * * * *